US006290110B1

(12) United States Patent
Boers

(10) Patent No.: US 6,290,110 B1
(45) **Date of Patent: *Sep. 18, 2001**

(54) FLUID SEAL FOR A POUR SPOUT OF A PAINT CONTAINER LID MEMBER

(75) Inventor: Arie Boers, Plymouth, MN (US)

(73) Assignee: X-Pert Paint Mixing Systems, Inc., Roseville, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/416,871

(22) Filed: Oct. 13, 1999

(51) Int. Cl.[7] ..... B65B 1/30
(52) U.S. Cl. ..... 222/559; 222/166; 222/472
(58) Field of Search ..... 222/144, 153.01, 222/153.03, 164, 166, 470–474, 559, 562, 563, 570, 571

(56) References Cited

U.S. PATENT DOCUMENTS

| | | | | |
|---|---|---|---|---|
| 1,897,890 | | 2/1933 | Cook . | |
| 2,027,297 | | 1/1936 | Tramposch | 259/107 |
| 2,035,646 | | 3/1936 | Farrington | 259/108 |
| 2,050,809 | * | 8/1936 | Ruetz | 222/559 |
| 2,068,646 | | 1/1937 | Hexter | 226/100 |
| 2,111,482 | * | 3/1938 | Ruetz | 222/559 |
| 2,370,997 | * | 3/1945 | Rudolph | 222/559 |
| 2,423,969 | | 7/1947 | Foltz | 259/58 |
| 2,428,492 | | 10/1947 | Haller | 259/67 |
| 2,521,384 | | 9/1950 | Marienthal | 259/66 |
| 2,585,334 | | 2/1952 | McCauley | 220/55 |
| 2,603,461 | | 7/1952 | Marienthal | 259/64 |
| 2,636,643 | | 4/1953 | McCauley | 222/80 |
| 2,757,910 | | 8/1956 | O'Neill | 259/108 |
| 2,802,649 | | 8/1957 | Stockton | 259/67 |
| 2,898,094 | | 8/1959 | O'Neill, Jr. | 259/116 |
| 2,965,363 | | 12/1960 | Worden | 259/67 |
| 3,021,118 | | 2/1962 | Dedoes | 259/43 |
| 3,041,052 | | 6/1962 | Dedoes | 259/122 |

(List continued on next page.)

FOREIGN PATENT DOCUMENTS

| | | |
|---|---|---|
| 858607 | 12/1952 | (DE) . |
| 29 51 731 | 7/1980 | (DE) . |
| 0 035 422 A1 | 9/1981 | (EP) . |
| 0 127 589 A2 | 12/1984 | (EP) . |
| 0 298 806 A1 | 1/1989 | (EP) . |
| 2102417 | 4/1972 | (FR) . |
| 2562874 | 10/1985 | (FR) . |
| 2742072 | 1/1998 | (FR) . |
| 2 203 059 | 10/1988 | (GB) . |

*Primary Examiner*—J. Casimer Jacyna
(74) *Attorney, Agent, or Firm*—Dicke, Billig & Czaja, P.A.

(57) ABSTRACT

Disclosed is a lid member for an original container of a liquid paint component. The lid member is usable with a system for dispensing the paint component from its original container into a paint receptacle according to a paint formula to form a liquid paint mixture. The lid member includes a base portion that is adapted to releasably engage an open top of the paint component container. The base portion has a pour spout through which the paint component can be dispensed, and a movable cover element. The cover element is movable between a closed state, wherein the cover element covers the pour spout, and an opened state, wherein the pour spout is uncovered and the paint component can be dispensed from its original container and into the paint receptacle. A resilient seal mechanism is positioned between the pour spout and the movable cover element. The resilient seal mechanism prevents leakage of the paint component, upon tilting of the original container, out of the pour spout past the cover element in the closed state of the cover element.

13 Claims, 16 Drawing Sheets

U.S. PATENT DOCUMENTS

| | | | |
|---|---|---|---|
| 3,118,653 | 1/1964 | Dedoes | 259/66 |
| 3,147,891 | 9/1964 | Fielitz | 222/166 |
| 3,162,338 | 12/1964 | Grubelic | 222/484 |
| 3,175,808 | 3/1965 | Dedoes | 259/107 |
| 3,284,057 | 11/1966 | Duquette | 259/88 |
| 3,350,083 | 10/1967 | Buhrer et al. | 266/38 |
| 3,412,937 | 11/1968 | Chamberlain | 239/142 |
| 3,670,785 | 6/1972 | Heiss et al. | 141/9 |
| 3,797,744 | 3/1974 | Smith | 239/172 |
| 3,930,598 | 1/1976 | Slagle | 222/129.4 |
| 4,090,475 | 5/1978 | Kwan | 222/70 |
| 4,127,212 | 11/1978 | Waterbury | 220/254 |
| 4,163,523 | 8/1979 | Vincent | 239/305 |
| 4,225,248 | 9/1980 | Para | 366/251 |
| 4,299,500 | 11/1981 | Bassetti | 366/198 |
| 4,372,666 | 2/1983 | Kaufmann | 354/298 |
| 4,380,399 | 4/1983 | Godat et al. | 366/289 |
| 4,407,584 | 10/1983 | Boudin et al. | 366/279 |
| 4,538,222 | 8/1985 | Crain et al. | 364/172 |
| 4,585,148 | 4/1986 | Ito | 222/77 |
| 4,630,654 | 12/1986 | Kennedy, Jr. | 141/83 |
| 4,671,892 | 6/1987 | Bereiter | 252/370 |
| 4,691,850 | 9/1987 | Kirschmann et al. | 222/642 |
| 4,750,648 | 6/1988 | Krydiak | 222/484 |
| 4,781,312 | 11/1988 | Strazdins | 222/309 |
| 4,792,236 | 12/1988 | Heinis et al. | 366/245 |
| 4,793,528 | 12/1988 | Krzywdziak | 222/487 |
| 4,845,965 | 7/1989 | Copeland et al. | 68/17 R |
| 4,898,308 | 2/1990 | Rudick | 222/325 |
| 4,926,390 | 5/1990 | Murzsa | 366/249 |
| 4,941,596 | 7/1990 | Marty et al. | 222/144.5 |
| 4,946,100 | 8/1990 | Flemming et al. | 239/1 |
| 4,967,938 | 11/1990 | Hellenberg | 222/144 |
| 4,976,137 | 12/1990 | Decker et al. | 73/53 |
| 5,020,700 | 6/1991 | Krzywdziak et al. | 222/487 |
| 5,020,917 | 6/1991 | Homan | 366/161 |
| 5,027,284 | 6/1991 | Senghaas et al. | 364/479 |
| 5,056,686 | 10/1991 | Jarrett | 222/129.2 |
| 5,078,302 | 1/1992 | Hellenberg | 222/144 |
| 5,094,543 | 3/1992 | Mursa | 366/247 |
| 5,096,071 | 3/1992 | Neri | 211/71 |
| 5,115,842 | 5/1992 | Crafts et al. | 141/286 |
| 5,119,973 | 6/1992 | Miller et al. | 222/144 |
| 5,153,825 | 10/1992 | Yauk et al. | 364/401 |
| 5,156,194 | 10/1992 | Von Nehring et al. | 141/1 |
| 5,160,198 | 11/1992 | Fillon | 366/198 |
| 5,169,232 | 12/1992 | Fillon et al. | 366/249 |
| 5,199,788 | 4/1993 | Stallings | 366/247 |
| 5,203,366 | 4/1993 | Czeck et al. | 137/3 |
| 5,251,979 | 10/1993 | Larsen | 366/248 |
| 5,310,258 | 5/1994 | Godat et al. | 366/251 |
| 5,335,806 | 8/1994 | Dedoes | 220/358 |
| 5,358,153 | 10/1994 | Caldwell et al. | 222/505 |
| 5,368,388 | 11/1994 | Fillon | 366/245 |
| 5,368,389 | 11/1994 | Dedoes | 366/247 |
| 5,413,257 | 5/1995 | Amberger et al. | 222/472 |
| 5,437,385 | 8/1995 | Fillon | 220/238 |
| 5,454,639 | 10/1995 | Krzywdziak | 366/279 |
| 5,456,534 | 10/1995 | Krzywdziak | 366/249 |
| 5,472,277 | 12/1995 | Dedoes | 366/247 |
| 5,474,211 | 12/1995 | Hellenberg | 222/1 |
| 5,482,370 | 1/1996 | Dedoes | 366/247 |
| 5,493,840 | 2/1996 | Cane | 53/50 |
| 5,496,109 | 3/1996 | Dedoes | 366/198 |
| 5,498,076 | 3/1996 | Krzywdziak | 366/245 |
| 5,498,077 | 3/1996 | Krzywdzjak et al. | 366/247 |
| 5,503,474 | 4/1996 | Krzywdziak | 366/347 |
| 5,511,878 | 4/1996 | Dedoes et al. | 366/198 |
| 5,533,802 | 7/1996 | Garganese | 366/256 |
| 5,542,761 | 8/1996 | Dedoes | 366/198 |
| 5,586,822 | 12/1996 | Krzywdziak | 366/247 |
| 5,603,426 | 2/1997 | Krzywdziak et al. | 220/324 |
| 5,622,289 | 4/1997 | Dedoes | 222/472 |
| 5,676,463 | 10/1997 | Larsen | 366/251 |
| 5,687,885 | 11/1997 | Turk et al. | 222/512 |
| 5,697,703 | 12/1997 | Lucchetti | 366/198 |
| 5,800,057 | 9/1998 | Lesimple | 366/198 |
| 5,813,760 | 9/1998 | Strong | 366/258 |
| 5,839,825 | 11/1998 | Krzywdziak | 366/247 |
| 5,904,420 | 5/1999 | Dedoes | 366/198 |
| 5,947,598 | 9/1999 | Dedoes | 366/198 |
| 5,988,868 | 11/1999 | Dedoes | 366/198 |
| 6,053,218 | 4/2000 | Boers | 141/83 |
| 6,095,373 | 8/2000 | Boers | 222/166 |

* cited by examiner

FLUID SEAL FOR A POUR SPOUT OF A PAINT CONTAINER LID MEMBER

CROSS REFERENCE TO RELATED APPLICATIONS

This patent application is related to U.S. patent application Ser. No. 09/189,338, entitled "Paint Container Lid For A Semi-Automated Automotive Paint Dispensing System"; and Ser. No. 09/189,214 entitled "SemiAutomated System For Dispensing Automotive Paint", both of which were filed on Nov. 10, 1998, assigned to the same assignee as herein, and incorporated herein by reference thereto. In addition, this patent application is related to U.S. patent application Ser. No. 09/417,933, entitled "Semi-Automated Automotive Paint Dispensing System" filed on even date herewith, assigned to the same assignee, and incorporated herein by reference thereto; to U.S. patent application Ser. No. 09/416,729, entitled "Lid Member For A Paint Container Useable With A Semi-Automated Automotive Paint Dispensing System" filed on even date herewith, assigned to the same assignee, and incorporated herein by reference thereto; and to U.S. patent application Ser. No. 09/416,728, entitled "Universal Paint Container Lid Member" filed on even date herewith, assigned to the same assignee, and incorporated herein by reference thereto.

TECHNICAL FIELD

This invention relates to mixing paint components, such as colorants, tints and pearls, to create automotive paint formulas. In particular, the present invention is a fluid seal mechanism positioned between a pour spout and a linearly movable cover element of a paint container lid that can be secured to an original paint component container and is useable with a semi-automated system for dispensing paint components according to a desired paint formula. The fluid seal mechanism prevents contaminants from entering the original paint component container through the pour spout and prevents undesired leakage of the paint component out of the pour spout and past the cover element.

BACKGROUND OF THE INVENTION

In the automotive body repair industry, paint vendors provide auto body repair businesses, such as body shops and jobbers, with their paint formulas. Generally, these paint formulas are a composition (i.e., mixture) of paint components, such as colorants, tints, pearls, metallics, binders and/or balancers, that, once mixed, produce the desired color of paint to be applied to a repaired vehicle. The paint formulas of the paint vendors are formulated to match the colors that have been applied to vehicles by new car manufacturers over the years. In addition, these paint formulas include variants, to match the color fading of paint that can occur to a vehicle over years of service. Moreover, the palettes of paint formulas of the paint vendors also have custom colors (i.e., unconventional colors not typically used by vehicle manufacturers) that may be used to produce special finishes for custom or show cars. Hence, paint vendors provide body shops and jobbers with literally thousands of paint formulas for producing the vast spectrum of colors needed in the automotive body repair industry.

In the past, paint vendors would provide the body shops and jobbers with microfiche containing their paint formulas. Today the paint formulas are stored in computer memory. To determine the particular paint formula for a particular vehicle repair/paint job, a system operator, such as an employee of the body shop or jobber, first obtains the color code from the vehicle. This color code is typically part of the vehicle's identification number. In the case of an unconventional color, to be used to produce a custom paint finish, the code for a particular color is obtained from a catalog. This color code is then entered into the microprocessor of the computer, which accesses the computer memory, and displays, via a monitor, the paint vendor's paint formula which matches the identified vehicle color code.

The paint formulas are displayed according to the weight of the different paint components for mixing specific quantities of the paint formula, and the order in which the displayed paint components are to be mixed. Typically, paint formula mixing quantities are listed in quart, half gallon and gallon sizes, while the weight of the particular paint components needed to mix the desired quantity of paint, are listed in grams to a precision of a tenth of a gram. Generally, the paint components comprising tints, colorants, pearls and/or metallics are mixed first, while the paint components comprising binders and/or balancers are added last. Depending on the desired color, the paint formula can require just a few paint components, or over a dozen paint components, that must be mixed with a great degree of precision, to achieve a perfect color match.

Once the system operator determines that the correct desired paint formula is displayed on the computer monitor, the operator places a paint receptacle on a weigh cell that is linked to the microprocessor of the computer. Generally, a receptacle larger than the quantity of paint formula to be mixed is used to accommodate any excess paint inadvertently mixed by the operator. With the receptacle on the weigh cell, the weigh cell is zeroed by the operator, to make ready for the process of adding paint components to the receptacle to mix the desired color paint formula. Generally, the various paint components (of which there are dozens) are stored in containers kept within a rack. The rack has a mechanism that periodically stirs the paint components within the containers, so that the various paint components are ready to be dispensed as part of the paint formula mixing process. Typically, these containers are the original quart and gallon sized metal containers within which the paint components are shipped to the body shop or jobber. In metric system countries, these containers are the original one liter and four liter sized metal containers within which the paint components are shipped to the body shop or jobber. The original covers of these containers are replaced by specialized paint container lids that include stirring paddles that work with the stirring mechanism of the rack. These specialized paint container lids also have pour spouts that allow the paint components of the containers to be dispensed (i.e., poured out) into the receptacle atop the weigh cell. The pour spout of the specialized paint container lid is covered by a cover element that helps to protect the paint component within the container from contaminants. The cover element for the pour spout is movable between an opened state in which the paint component can be poured from its container through the pour spout by tipping (i.e., tilting) the container, and a closed state. The specialized paint container lid typically includes a vent to allow air to enter the container to displace the liquid paint component dispensed from the pour spout.

To reproduce the desired paint formula, the system operator begins by identifying the first listed paint component of the paint formula to be mixed. The operator then pours, by hand, the paint component into the weigh cell supported paint receptacle, until the weight of the paint component dispensed (i.e., poured) into the receptacle matches what is displayed on the computer monitor. The operator continues along on this course (i.e., hand pouring the paint components from their containers), until the correct weight of all paint components, needed to mix the desired color paint formula, have been added to the paint receptacle atop the weigh cell.

Although the above described system for mixing paint components (according to a paint formula), using the original containers of the liquid paint components and the above described specialized container lids, allows a skilled system operator to dispense the needed paint components to adequately recreate paint colors needed for repair/paint jobs, there are some disadvantages to this system. For example, during the process of dispensing the liquid paint component from the specialized container lid, the liquid paint component often undesirably flows out of the pour spout past the cover element when the cover element is in the closed position. In addition contaminants can enter the original container through the cover element/pour spout interface thereby adversely affecting the quality of the paint component contained within the original container. Moreover, to mix a desired paint formula requires that the paint components be added to the paint receptacle, atop the weigh cell, with a great degree of accuracy. This accuracy, as stated earlier, is typically to a precision of 0.1 grams. For even a highly skilled operator this great degree of precision is difficult to obtain when hand pouring the paint components needed to mix the desired paint formula. It is especially difficult when many paint components must be poured into the paint receptacle in order to duplicate the paint formula.

The most common error on the part of the system operator of the body shop or jobber is over pouring which is due primarily to the manual labor intensive nature of the paint component dispensing process. Over pouring occurs when the weight of the paint component added to the receptacle atop the weigh cell, exceeds the weight of the component shown on the computer display for the desired paint formula. When this happens, the microprocessor of the computer recalculates the weights of the other paint components that need to be added to the receptacle to compensate for the over poured component. This recalculation is done automatically by the microprocessor since the weigh cell is linked to the computer. Based upon this recalculation, the system operator then needs to re-pour the other paint components to offset the over poured component of the paint formula.

While this re-pouring task may not be difficult when the paint formula only has a few paint components, the re-pouring task is particularly time consuming when there is a great number of components in the paint formula. Specifically, if an over pouring error is made in the last paint component of a series of ten components of a paint formula, then all of the previous nine components may have to be re-poured to compensate. This re-pouring task may be further complicated if another error is made during the re-pouring of the paint components, as this further error may require that some components be re-poured two or three times until the paint formula is finally accurately reproduced. Hence, over pouring errors can be costly to a body shop or jobber because of the additional man hours needed to mix the paint formula.

Not only are over pouring errors expensive because of the additional man hours needed to reproduce the paint formula, over pouring errors are also costly in the amount of additional paint formula that is mixed because of the errors. Automotive paint can cost in excess of $100.00 per quart. An over pouring error of just one pint may translate into an additional cost of $50.00 that a body shop or jobber may have to absorb, unless this additional paint cost can be justified to an automobile collision insurance carrier. Moreover, this additional paint, if not used in the repair/paint job, becomes a hazardous waste that must be disposed of properly, thereby adding still more costs that are attributable to paint component over pouring errors.

There is a need for an improved system for mixing paint components according to a paint formula. In particular, there is a need for paint container lid members, that can be used with the original containers of the paint components, and are compatible with a system for dispensing paint components according to a paint formula that substantially eliminates system operator errors, specifically over pouring errors, that can be costly to a body shop or jobber. The paint container lid members together with the paint component dispensing system should be easy to use, so as not to require a highly skilled operator, and should make better use of an operator's time to allow an operator to mix a greater number of paint formulas during a work day. Moreover, the paint container lid members should prevent contaminants from entering the original paint component container through the pour spout/cover element interface and prevent undesired leakage of the paint component out of the pour spout and past the cover element in the closed state of the cover element. In addition, the paint component lid members and the paint component dispensing system should comply with all regulations and laws governing the handling and mixing of paint components for the duplication of automotive paint formulas.

SUMMARY OF THE INVENTION

The present invention is a lid member for an original container of a pourable component, such as a liquid paint component. The lid member is usable with a system for dispensing the paint component from its original container into a paint receptacle according to a paint formula to form a liquid paint mixture. The lid member includes a base portion that is adapted to releasably engage an open top of a side wall of the paint component container. The base portion has a pour spout through which the paint component can be dispensed and a movable cover element. The cover element is movable between a closed state, wherein the cover element covers the pour spout, and an opened state, wherein the pour spout is uncovered and the paint component can be dispensed from its original container, through the pour spout, and into the paint receptacle upon tilting of the original cylindrical container. A resilient seal mechanism is positioned between the pour spout and the movable cover element. The resilient seal mechanism prevents leakage of the paint component, upon tilting of the original container, out of the pour spout past the cover element in the closed state of the cover element.

This lid member can be used with the original container of a liquid paint component, and the resilient seal mechanism prevents contaminants from entering the original paint component container through the pour spout/cover element interface. In addition, the resilient seal mechanism of this lid member prevents undesired leakage of the paint component out of the pour spout and past the cover element in the closed state of the cover element. Moreover, this lid member is compatible with a semi-automated system for dispensing liquid paint components from their original containers that virtually eliminates system operator errors, in particular over pouring errors, that can be costly to a body shop or jobber. The lid member and the semi-automated dispensing system are easy to use, and do not require a highly skilled operator, since operator interface with the lid members and the dispensing system is substantially limited to identifying the desired paint formula, and loading and unloading the proper containers of the liquid paint components to and from the dispensing apparatus.

The dispensing system automatically dispenses (i.e., pours) the liquid paint components from their containers, thereby ensuring a highly accurate, precision liquid paint component pour. This highly accurate liquid paint component pour substantially limits the additional cost of the added paint components attributable to over pouring errors. In addition, the lid members of the present invention together with the paint dispensing system makes efficient use of the operator's time, since the operator is free to perform other duties instead of manually pouring the proper amounts of the liquid paint components from their containers. This efficiency gain allows the operator to mix a greater number of paint formulas during a work day. Lastly, the paint component lid members, of the present invention, together with the semi-automated dispensing system complies with all regulations and laws (such as being explosion protected) governing the safe handling and mixing of liquid paint components for the duplication of automotive paint formulas.

BRIEF DESCRIPTION OF THE DRAWINGS

The accompanying drawings are included to provide a further understanding of the present invention and are incorporated in and constitute a part of this specification. The drawings illustrate the embodiments of the present invention and together with the description serve to explain the principals of the invention. Other embodiments of the present invention and many of the intended advantages of the present invention will be readily appreciated as the same become better understood by reference to the following detailed description when considered in connection with the accompanying drawings, in which like reference numerals designate like parts throughout the figures thereof, and wherein.

DETAILED DESCRIPTION OF THE PREFERRED EMBODIMENTS

Figure 1:
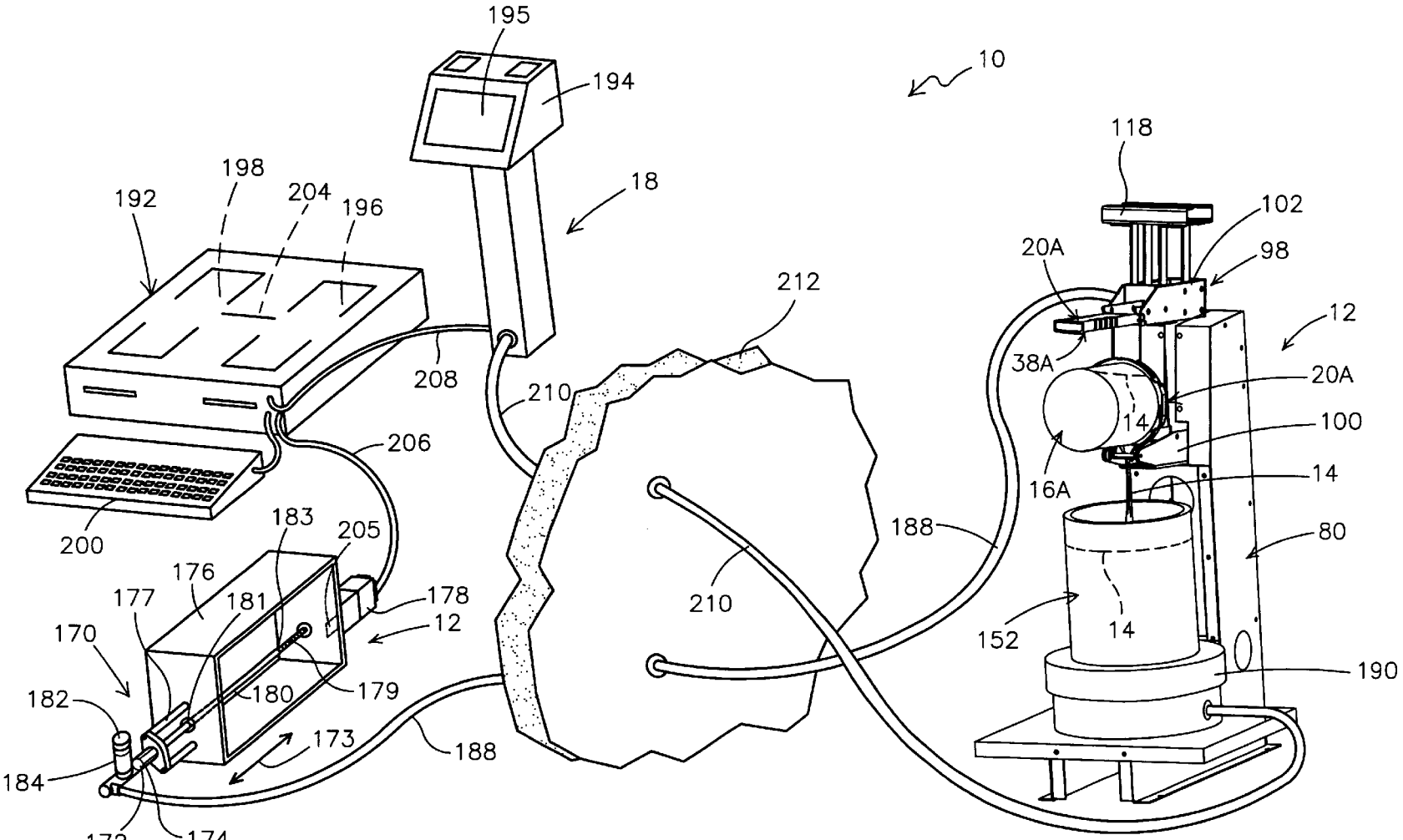
FIG. 1 is a perspective view illustrating a dispensing and control apparatus of a semi-automated system for dispensing liquid paint components from their original containers in accordance with the present invention.
Figure 2:
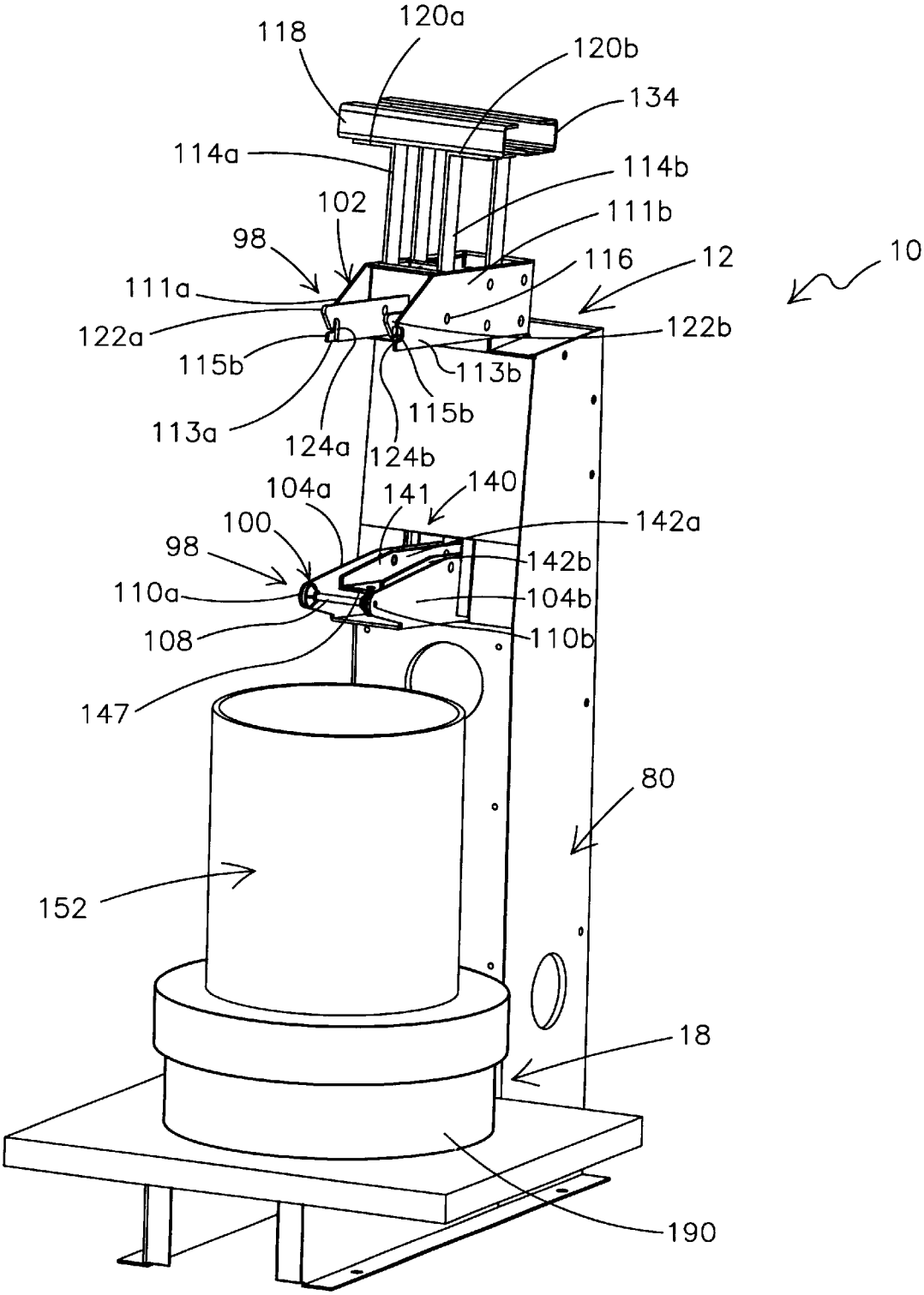
FIG. 2 is an enlarged perspective view better illustrating the dispensing apparatus of the dispensing system of FIG. 1.
Figure 11:
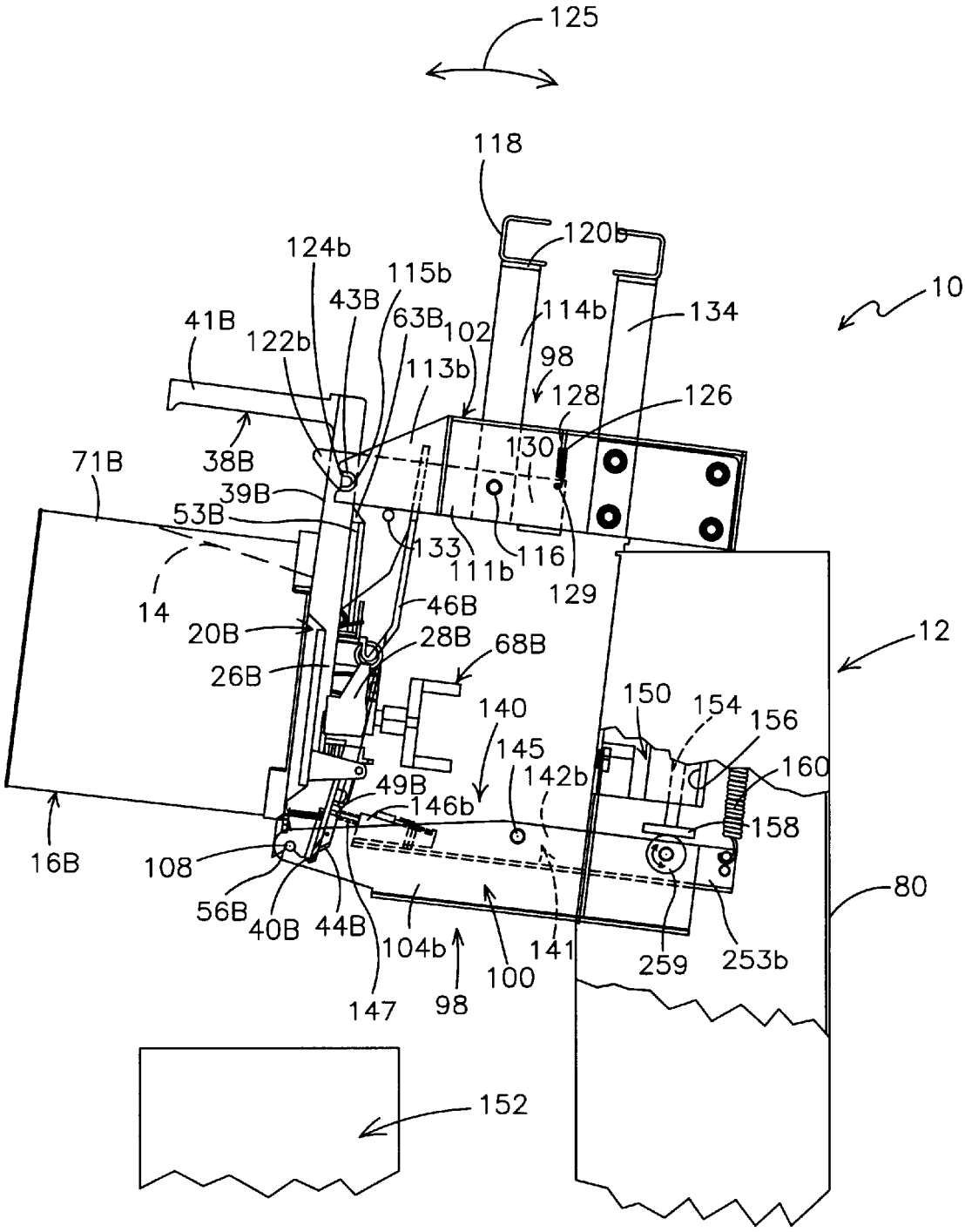
FIG. 11 is a partial side elevational view with some parts omitted for clarity similar to FIG. 7, illustrating a gallon size original container ready for dispensing of a liquid paint component.

A semi-automated dispensing system 10 for dispensing liquid paint components according to a paint formula to form a liquid paint mixture in accordance with the present invention is illustrated generally in FIGS. 1 and 2. The dispensing system 10 generally comprises a dispensing apparatus 12 for dispensing a liquid paint component 14 from its original container 16A and 16B, and a control apparatus 18 for controlling the dispensing apparatus 12. FIGS. 1, 3–8 show the quart size original container 16A having a lid member 20A, while FIG. 11 illustrates the gallon size original container 16B having a lid member 20B. In metric system countries, the lid member 20A fits a one liter size original container and the lid member 20B fits a four liter size original container. The containers 16A and 16B (without the lid members 20A and 20B) are typical cylindrical shaped, metal vessels within which liquid paint components 14, such as tints, colorants, pearls, metallics, binders and balancers (used to mix automotive paint according to a paint formula) are shipped from a liquid paint component manufacturer to customers, such as body shops and jobbers. Beyond their size differences, the quart size and gallon size containers 16A and 16B are substantially identical. Therefore, only the quart size original container will be described with particularity. The lid members 20A and 20B are substantially similar, therefore the quart size lid member 20A will be described with particularity, and only the differences in the gallon size lid member 20B relative to the quart size lid member 20A will be described with particularity.

Figure 3A:
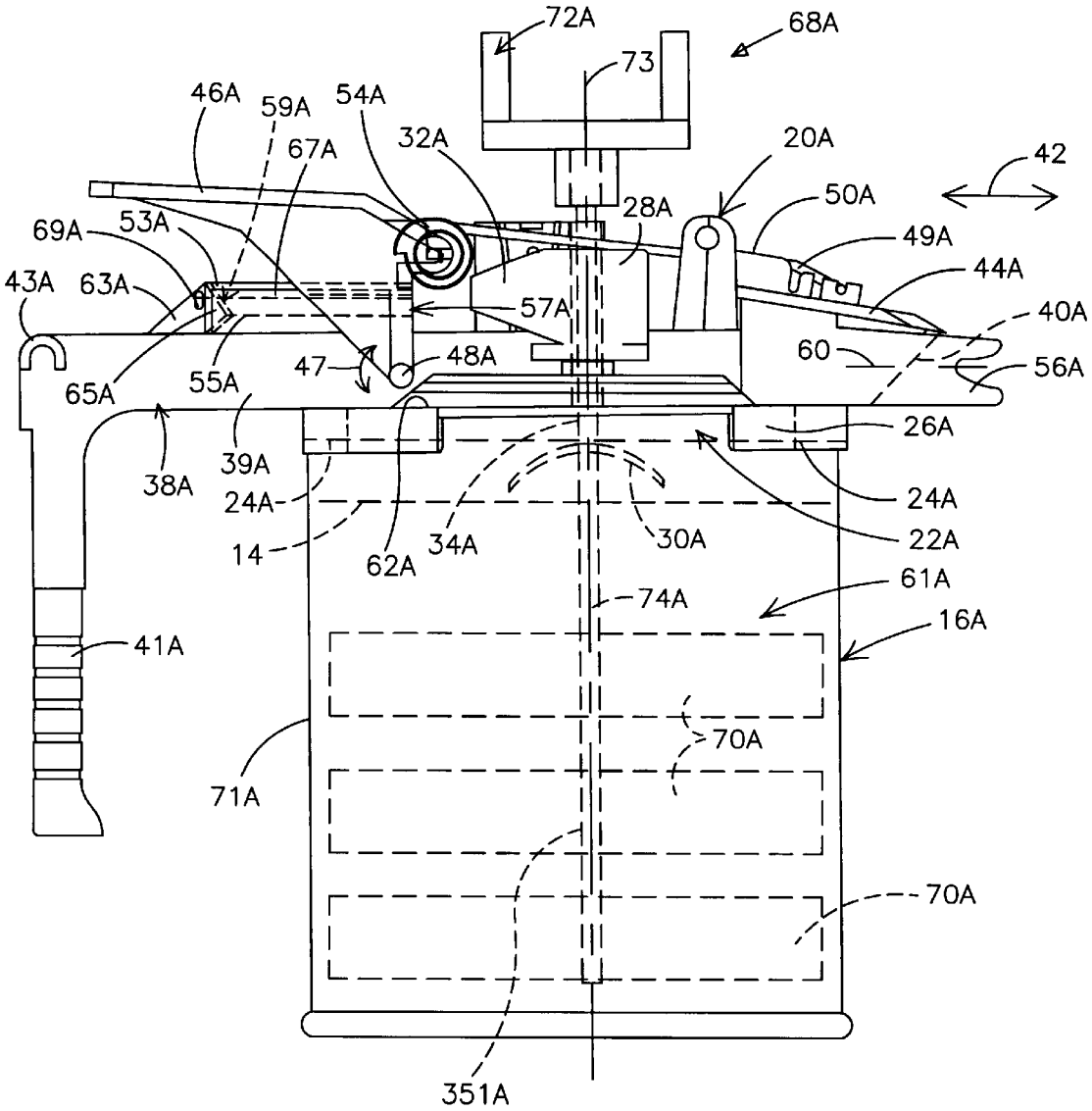
FIG. 3A is a side elevational view of a quart size original paint container and lid member for holding a liquid paint component with a cover element and vent mechanism shown in a closed position.
Figure 3B:
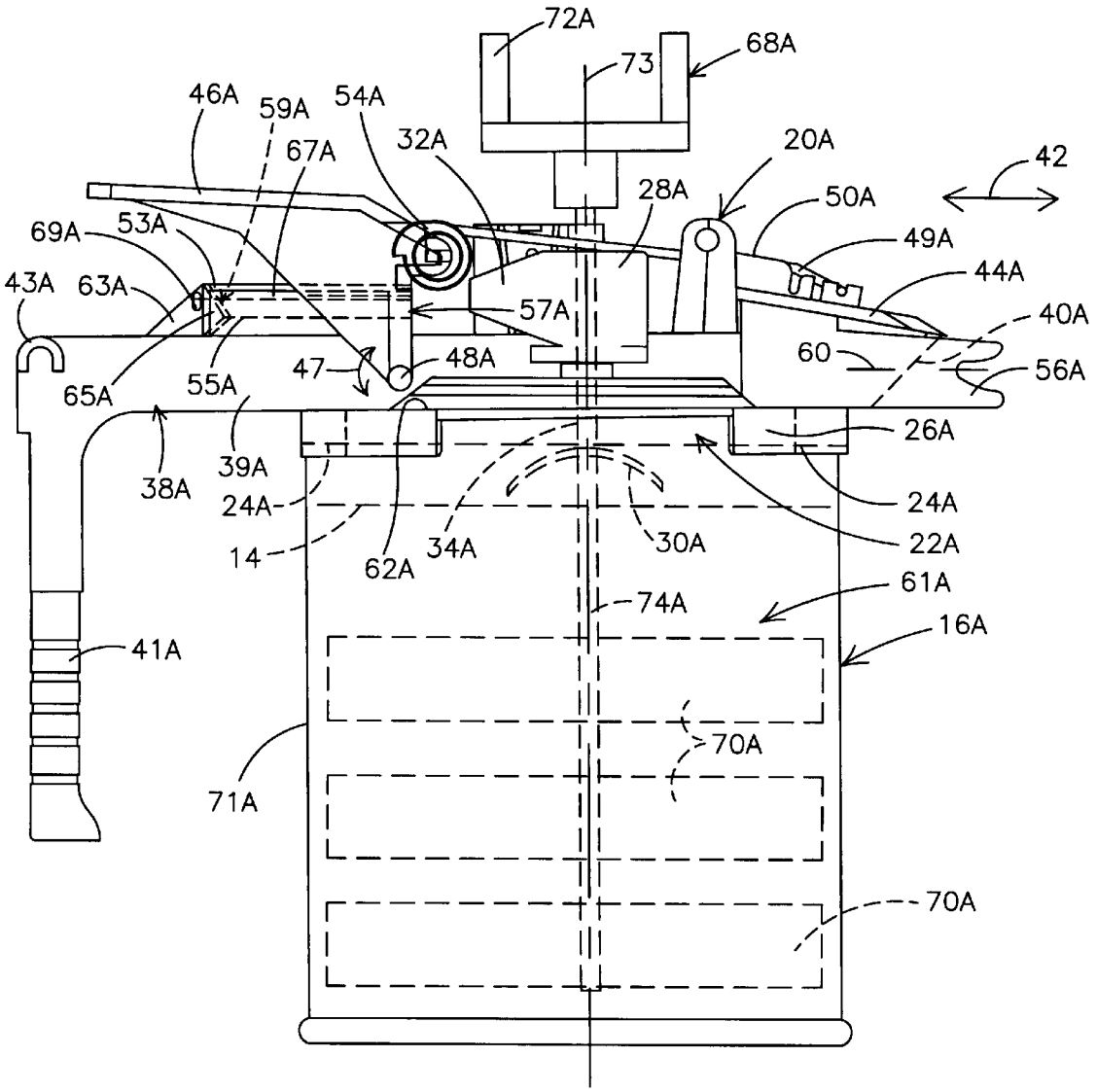
FIG. 3B is a side elevational view similar to FIG. 3A of the quart size original paint container and lid member for holding a liquid paint component with the cover element and vent mechanism shown in an open position.

As seen best in FIGS. 3A and 3B, the original container 16A is cylindrical shaped having an open top 22A defined by a circumferential lip 24A. As seen best in FIGS. 3–5, the lid member 20A includes a base portion 26A adapted to engage and seal the open top 22A of the container 16A to protect the liquid paint component 14 within the container 16A. The base portion 26A of the lid member 20A includes a pair of spaced, pivotable cam lock mechanisms 28A that are used to releasably secure the lid member 20A to the original container 16A. Each of the cam lock mechanisms 28A is defined by a cam element 30A connected to a cam actuator 32A by way of a post member 34A. Pivotally moving the cam actuators 32A by hand, as represented by double headed arrow 36 (see FIG. 4), moves the cam elements 30A into and out of engagement with the lip 24A to secure and release the lid member 20A from the original container 16A.

The lid member 20A further includes a handle 38A, for easy handling of the original container 16A when the lid member 20A is secured thereto. The handle 38A includes a first portion 39A generally parallel to the lip 24A of the original container 16A, a second portion 41A (grasped by a user) that extends substantially perpendicular to the first portion 39, and a pair of oppositely directed dispensing system latch lugs 43A positioned at the intersection the first and second portions 39A, 41A. The purpose of the pair of dispensing system latch lugs 43A will become clear below. In the gallon size lid member 20B, as illustrated in FIG. 11, the pair of oppositely directed dispensing system latch lugs 43B are positioned along the length of the first portion 39B of the handle 38B instead of at the intersection of the first and second portions 39A and 41A as in the quart size lid member 20A. Other than the size differences between the quart size lid member 20A and the gallon size lid member 20B, this different positioning of the dispensing system latch lugs 43A, 43B constitutes the main and only real difference between the lid members 20A and 20B.

The lid member 20A also includes a liquid paint component pour spout 40A. The pour spout 40A is covered by a linearly movable, as represented by double headed directional arrow 42 (see FIGS. 3A and 3B), cover element 44A. The cover element 44A is linearly movable between a closed state (shown in FIG. 3A) and an opened state (shown in FIG. 3B). In the closed state of the cover element 44A, the liquid paint component 14 is prevented from being poured (i.e., dispensed) from the original container 16A through the pour spout 40A. In the opened state of the cover element 44A, the liquid paint component 14 can be poured from the original container 16A through the pour spout 40A by tilting the container 16A using the handle 38A.

Figure 4:
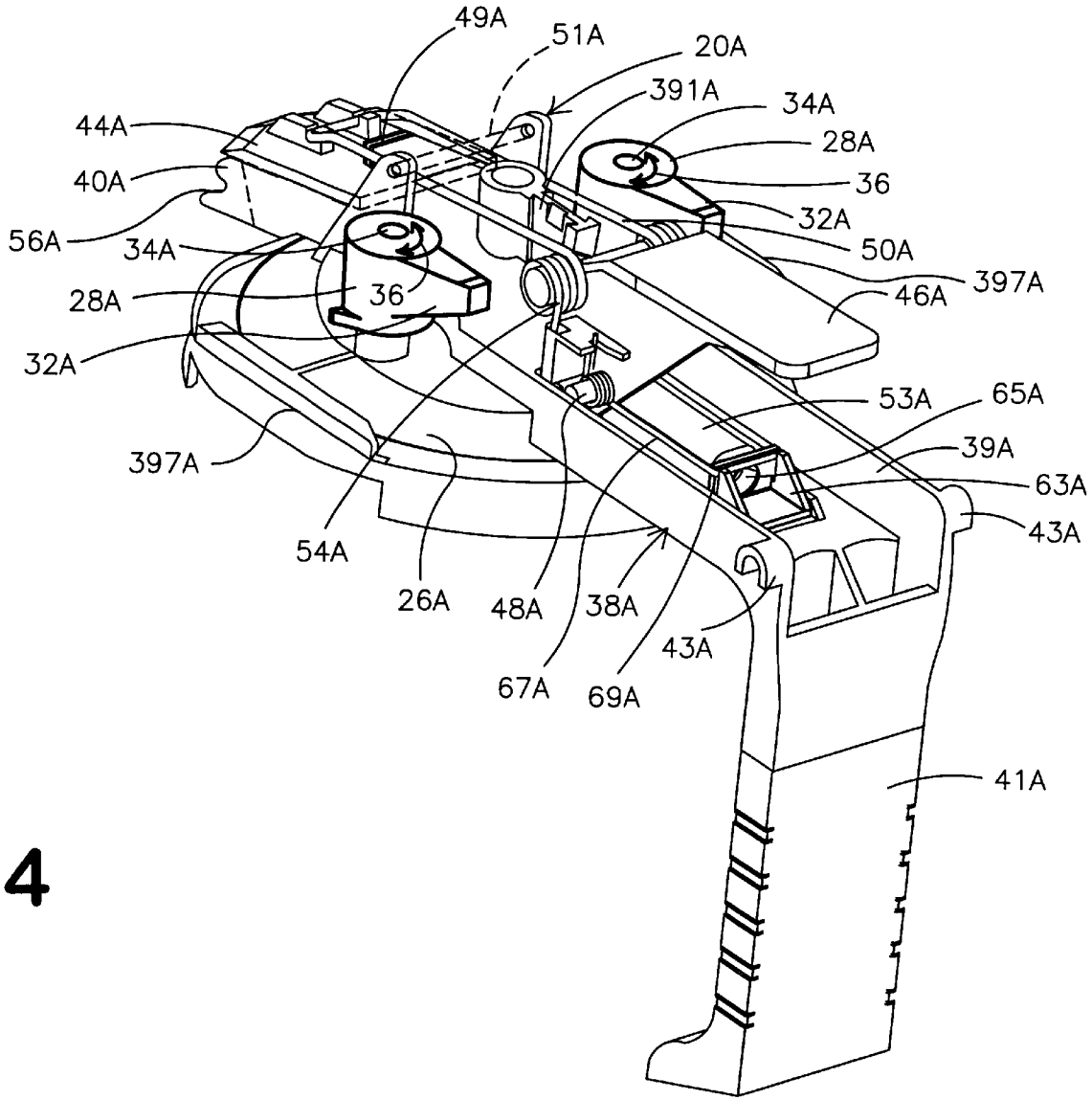
FIG. 4 is a perspective view of the quart size lid member shown in FIG. 3A.
Figure 5:
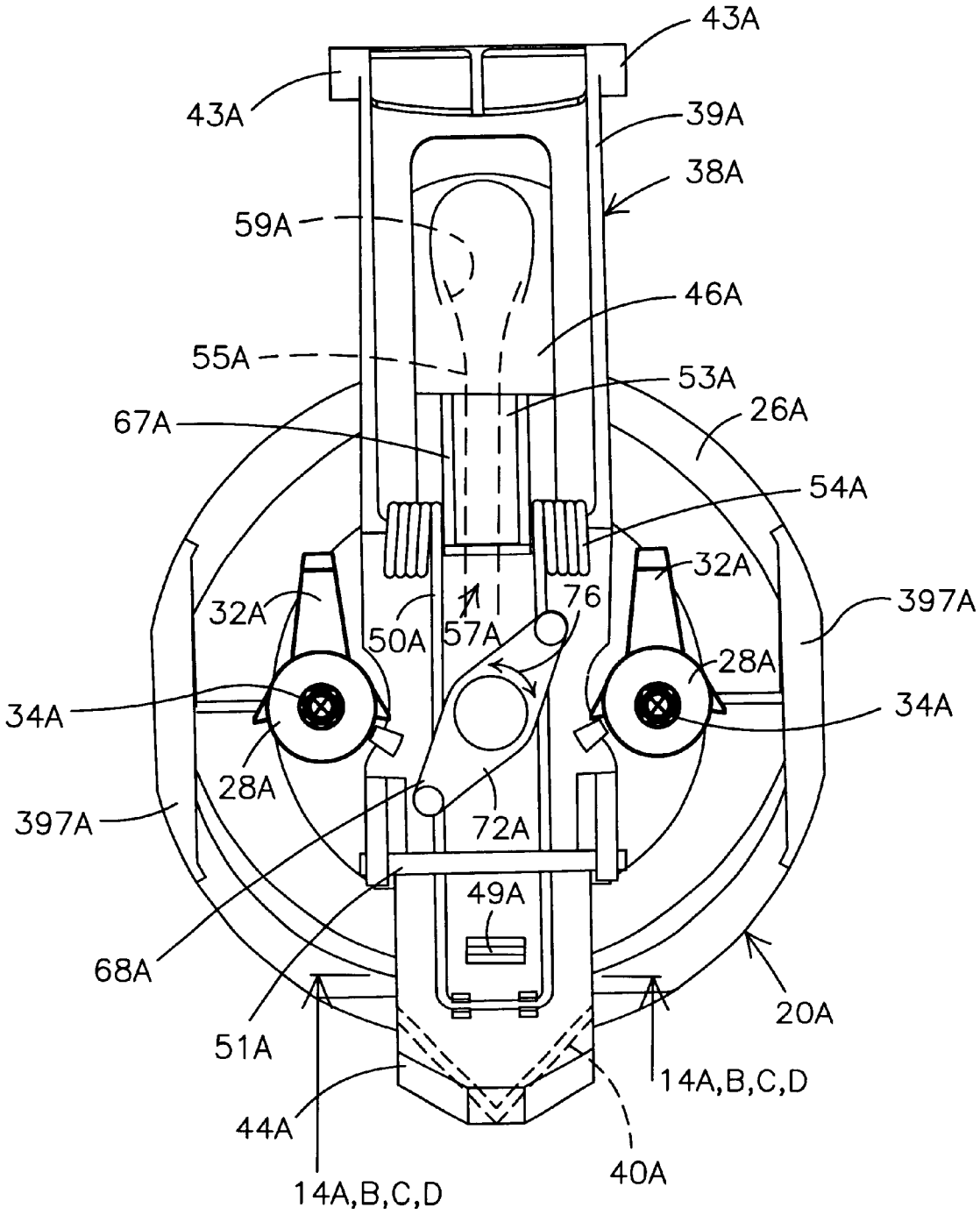
FIG. 5 is top elevational view of the paint container and lid member shown in FIG. 3A.

As seen when comparing FIGS. 3A and 3B, the cover element 44A is movable between its closed and opened states via a thumb actuator 46A that is pivotally secured to the base portion 26A by way of a pivot pin 48A. The thumb actuator 46A is pivotally movable as shown by double headed directional arrow 47. As seen best in FIG. 4, the thumb actuator 46A is connected to the cover element 44A via a wire loop 50A. When the thumb actuator 46A is positioned as shown in FIG. 3A, the cover element 44A is in its closed state. The thumb actuator 46A is biased to this normal position in a known manner by a coil spring element 54A (see FIGS. 3A and 3B). The coil spring element 54A acts between the base portion 26A and the thumb actuator 46A. When the thumb actuator 46A is positioned as shown in FIG. 3B, the cover element 44A is in its opened state. The cover element 44A is moved, from its closed state to its opened state, through the connecting wire loop 50A by pivoting the thumb actuator 46A about the pivot pin 48A against the bias of the spring element 54A. The cover element 44A is allowed to return to its closed state from the opened state by simply releasing the thumb actuator 46A. The lid member 20A also includes a rotatable roller element 51A (see FIGS. 4 and 5) that bears against the wire loop 50A to help maintain a seal between the cover element 44A and the pour spout 40A. As seen in FIGS. 3–5, the cover element 44A also includes a slot 49A the purpose of which will be made clear below.

As seen best in FIGS. 5 and 14A–D, the pour spout 40A includes a circumferential, planar edge surface 350A, and the cover element 44A includes a planar lower surface 352A. A resilient seal mechanism 354 is positioned at an engagement interface 356 between the circumferential, planar edge surface 350A of the pour spout 40A and the planar lower surface 352A of the cover element 44A. The resilient seal mechanism 354 prevents leakage, upon tilting of the original container 16A, of the liquid paint component 14 out of the pour spout 40A past the cover element 44A in the closed state of the cover element 44A.

Figure 14A:
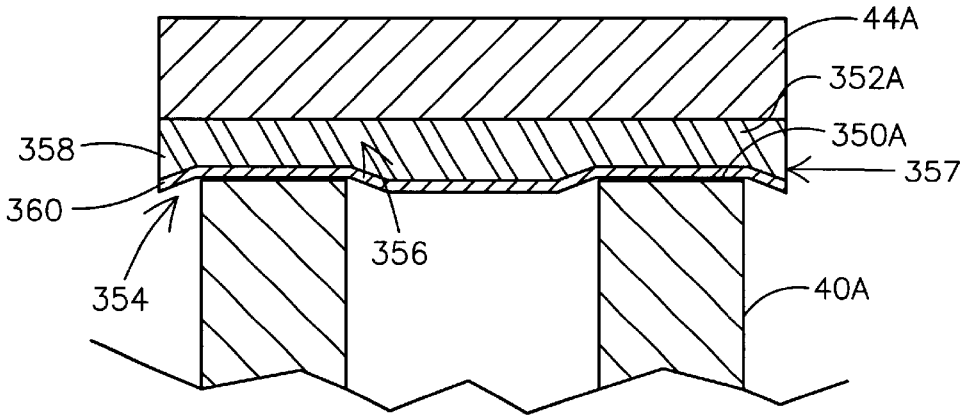
FIG. 14A is a sectional view taken along line 14A—14A in FIG. 5 illustrating a preferred embodiment of a resilient seal mechanism for the cover element/pour spout interface of the lid member in accordance with the present invention.

As illustrated in FIG. 14A, in one preferred embodiment, the resilient seal mechanism 354 is defined by a resilient seal member 357 that covers the entire planar lower surface 352A of the cover element 44A. The resilient seal member 357 comprises a first substrate 358 of a resilient material, such as foam, and a second substrate 360 of a smooth material, such as polyethylene. Alternatively, the second substrate 36 could comprise TEFLON. In one preferred embodiment, the first substrate 358 has a thickness of approximately 0.0003 inches and the second substrate 360 has a thickness of 0.0001 inches. The resilient seal member 357 is secured, via the first substrate 358, to the planar lower surface 352A of the cover element 44A via a suitable adhesive. The second substrate 360 engages the circumferential, planar edge surface 350A of the pour spout 40A. The smoothness of the second substrate 360 allows the cover element 44A to readily move relative to the pour spout between the open and closed states. As seen in FIG. 14A, the resiliency of the first substrate 358 allows the resilient seal member 357 to conform to the shape of the circumferential, planar edge surface 350A of the pour spout 40A. By conforming to the shape of the pour spout 40A, the resilient seal member 357 provides an excellent fluid seal that prevents contaminants from entering the original container 16A through the pour spout 40A, and prevents leakage, upon tilting of the original container 16A, of the liquid paint component 14 out of the pour spout 40A past the cover element 44A in the closed state of the cover element 44A.

Figure 14B:
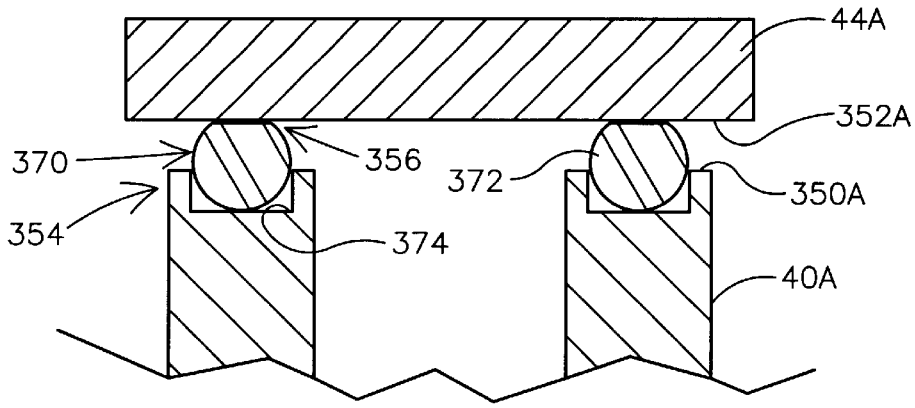
FIG. 14B is a sectional view taken along line 14B—14B in FIG. 5 illustrating an alternative embodiment of a resilient seal mechanism for the cover element/pour spout interface of the lid member in accordance with the present invention.

FIG. 14B illustrates an alternative resilient seal member 370. The resilient seal member 370 is defined by a rubber O-ring 372 that is mounted within a circumferentially extending channel 374 in the circumferential, planar edge surface 350A of the pour spout 40A. The resiliency of the rubber O-ring 372 allows the resilient seal member 370 to conform to the shape of the planar lower surface 352A of the cover element 44A. By conforming to the shape of the cover element 44A, the resilient seal member 356 provides an excellent fluid seal that prevents contaminants from entering the original container 16A through the pour spout 40A, and prevents leakage, upon tilting of the original container 16A, of the liquid paint component 14 out of the pour spout 40A past the cover element 44A in the closed state of the cover element 44A.

Figure 14C:
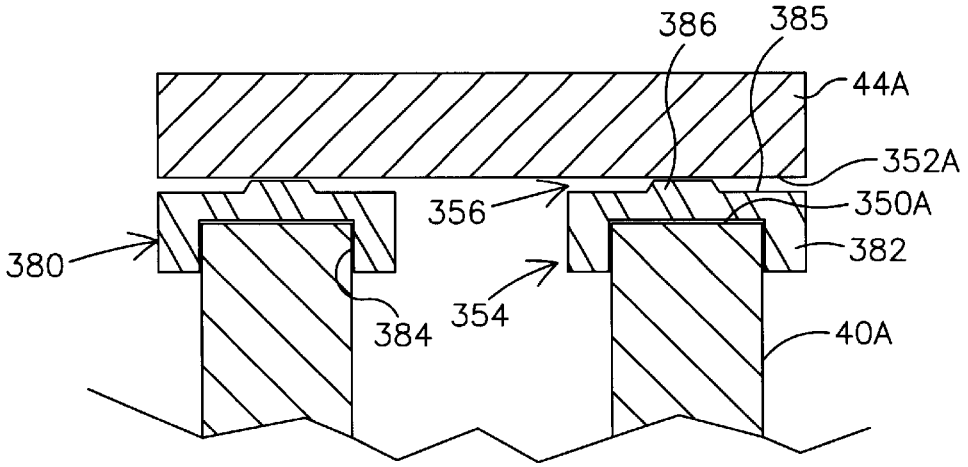
FIG. 14C is a sectional view taken along line 14C—14C in FIG. 5 illustrating another alternative embodiment of a resilient seal mechanism for the cover element/pour spout interface of the lid member in accordance with the present invention.

FIG. 14C illustrates another alternative resilient seal member 380. The resilient seal member 380 is defined by a generally U-shaped, rubber seal element 382 having an engagement channel 384 for receiving the circumferential, planar edge surface 350A of the pour spout 40A for mounting the resilient seal member 380 to the pour spout 40A. An upper surface 385 of the seal element 382 includes a circumferential ridge 386 that engages the planar lower surface 352A of the cover element 44A. The resiliency of the ridge 386 allows the resilient seal element 382 to conform to the shape of the planar lower surface 352A of the cover element 44A. By conforming to the shape of the cover element 44A, the resilient seal element 382 provides an excellent fluid seal that prevents contaminants from entering the original container 16A through the pour spout 40A, and prevents leakage, upon tilting of the original container 16A, of the liquid paint component 14 out of the pour spout 40A past the cover element 44A in the closed state of the cover element 44A.

Figure 14D:
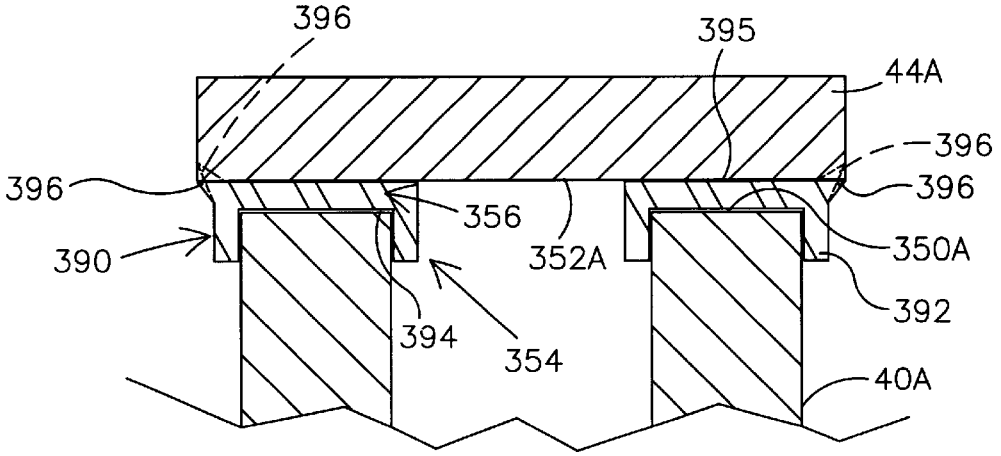
FIG. 14D is a sectional view taken along line 14D—14D in FIG. 5 illustrating still a further alternative embodiment of a resilient seal mechanism for the cover element/pour spout interface of the lid member in accordance with the present invention.

FIG. 14D illustrates a further alternative resilient seal member 390. The resilient seal member 390 is defined by a generally U-shaped, rubber seal element 392 having an engagement channel 394 for receiving the circumferential, planar edge surface 350A of the pour spout 40A for mounting the resilient seal member 390 to the pour spout 40A. An upper surface 395 of the seal element 392 includes a circumferential extension 396 that is directed exterior to the pour spout 40A and engages the planar lower surface 352A of the cover element 44A. The dashed line representation of the extension 396 is the normal inoperative state of the extension 396. The solid line representation of the extension 396 is the flexed operative state of the extension 396. The resiliency of the extension 396 allows the resilient seal element 392 to conform to the shape of the planar lower surface 352A of the cover element 44A. By conforming to the shape of the cover element 44A, the resilient seal element 392 provides an excellent fluid seal that prevents contaminants from entering the original container 16A through the pour spout 40A, and prevents leakage, upon tilting of the original container 16A, of the liquid paint component 14 out of the pour spout 40A past the cover element 44A in the closed state of the cover element 44A.

As seen in FIGS. 3–4, the base portion 26A of the lid member 20A includes a vent member 53A defining a vent passage 55A that has a first open end 57A and an opposite second open end 59A. The vent passage 55A passes through the base portion 26A such that the first open end 57A communicates with an interior region 61A of the original container 16A and the second open end 59A communicates with atmosphere. The second open end 59A is sealable by way of a linearly movable plug element 63A. As seen best when comparing FIGS. 3A and 3B, the plug element 63A is linearly movable between a sealed position (see FIG. 3A) wherein a cone shaped end 65A of the plug element 63A is engaged with the second open end 59A of the vent passage 55A, and an unsealed position (see FIG. 3B) wherein the cone shaped end 65A of the plug element 63A is disengaged from the second open end 59A of the vent passage 55A.

The plug element 63A is linearly movable between the sealed and unsealed positions by actuation of the thumb actuator 46A. The thumb actuator 46A is coupled to the plug element 63A by way of a wire loop element 67A that engages a groove 69A in the plug element 63A. Movement of the thumb actuator 46A between the positions shown in FIGS. 3A and 3B moves the plug element 63A (by way of the wire loop element 67A) between the sealed and unsealed positions. In the sealed position of the plug element 63A, contaminants are prevented from entering the vent passage 55A. In the unsealed position of the plug element 63A (which occurs when the liquid paint component 14 is being dispensed from the original container 16A through the pour spout 40A upon actuation of the thumb actuator 46A), air is allowed to enter the vent passage 55A through the second open end 59A so that the air passes into the interior region 61A of the original container 16A through the second open end 57A to fill the void of the dispensed liquid paint component 14.

As seen best in FIGS. 3–8, the second open end 59A of the vent passage 55A is located radially exterior to the cylindrical side wall 71A of the original container 16A. This location of the second open end 59A of the vent passage 55A prevents the liquid paint component 14 from flowing out of the original container 16A through the vent passage 55A and the subsequent fouling of the exterior portions of the lid member 20A. This undesirable condition is prevented because the second open end 59A of the vent passage 55A is located above the fluid level of the liquid paint component 14 in the dispensing state of the liquid paint component illustrated in FIGS. 8 and 11. The vent passage 55A extends substantially perpendicular to and radially from a central axis 73 of the original container 16A (see FIG. 3A).

As seen best in FIGS. 3 and 4, the lid member 20A further includes an alignment slot 56A positioned at a first portion of the lid member 20A at the pour spout 40A adjacent to the cover element 44A. As seen in FIGS. 3A and 3B, the alignment slot 56A is positioned so as to define a plane 60 that is parallel to an upper surface 62A of the circumferential lip 24A of the original container 16A. The purpose of the alignment slot 56A will become clear below. The alignment slot 56A is formed integrally with the base portion 26A of the lid member 20A.

As seen best in FIGS. 3A and 3B, the lid member 20A further includes a stirring device 68A for stirring the liquid paint component 14 within the original container 16A. The stirring device 68A includes a plurality of paddles 70A connected to a paddle actuator 72A by way of a shaft member 74A. Rotating the paddle actuator 72A, as represented by double headed directional arrow 76, causes rotation of the paddles 70A and stirring of the liquid paint component 14. The paddle actuator 72A is driven (i.e., rotated) by a stirring mechanism (not shown) that is part of a storage rack (not shown) for holding various original containers 16A of liquid paint components 14.

As seen best in FIGS. 1 and 2, the dispensing apparatus 12 of the dispensing system 10 includes a support frame 80. As seen best in FIGS. 2 and 6, the dispensing apparatus 12 further includes a receiving mechanism 98 for releasably engaging the original container 16A, 16B of the liquid paint component 14. The receiving mechanism 98 is defined by first and second engaging mechanisms 100 and 102, respectively.

Figure 6:
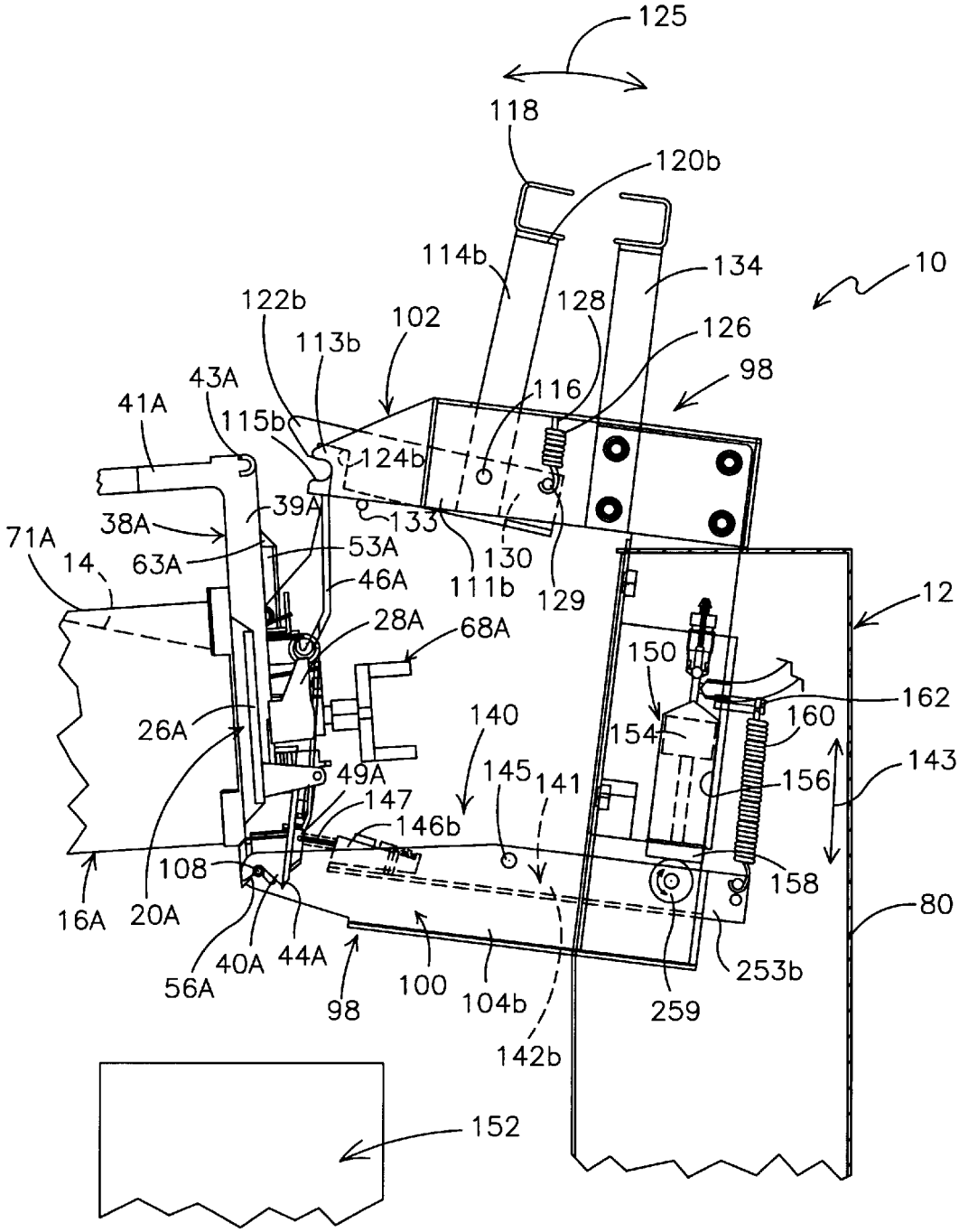
FIG. 6 is partial side elevational view with some parts omitted for clarity of the dispensing apparatus of FIGS. 1 and 2, illustrating a quart size original container of a paint component being loaded into/unloaded from the dispensing apparatus.
Figure 7:
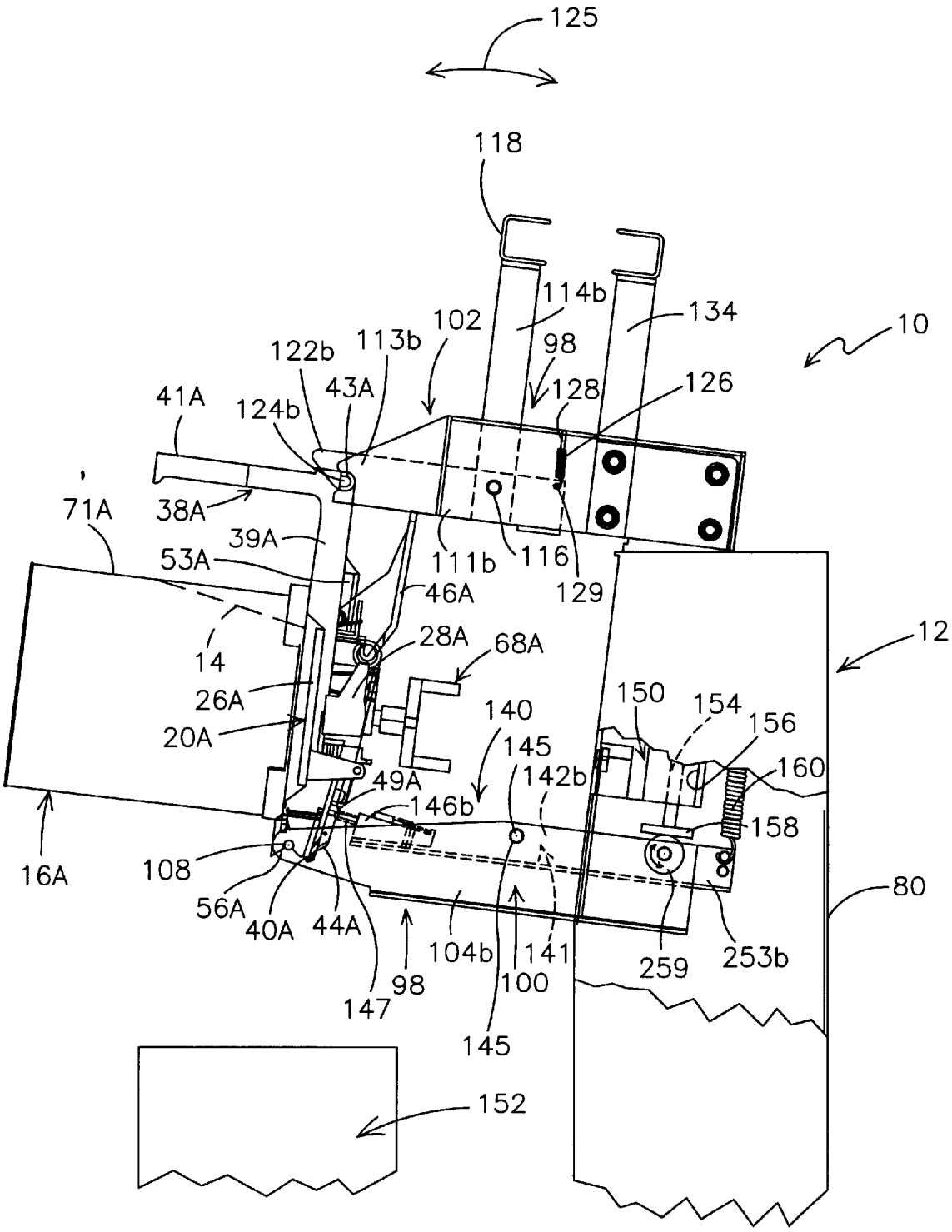
FIG. 7 is a partial side elevational view with some parts omitted for clarity similar to FIG. 6, illustrating the quart size original container ready for dispensing of the liquid paint component.

As seen best in FIG. 2, the first engaging mechanism 100 includes first and second spaced arms 104*a* and 104*b* rigidly mounted to the support frame so as to be fixed against movement relative thereto. A registration rod 108 rigidly connects together the first and second arms 104*a* and 104*b* at their free ends 110*a* and 110*b*. The registration rod 108 is adapted to releasably receive (i.e., engage) the alignment slot 56A of the lid member 20A. As seen in FIG. 6, interengagement of the alignment slot 56A with the registration rod 108 mounts (i.e., secures) and aligns a first portion of the container 16A and lid member 20A combination to the receiving mechanism 98 of the dispensing apparatus 12.

The second engaging mechanism 102 includes first and second spaced plates 111*a* and 111*b* fixed to an upper end of the support frame 80. Free ends 113*a* and 113*b* of the plates 111*a,* 111*b* include latch slots 115*a* and 115*b,* respectively. The second engaging mechanism 102 further includes first and second spaced L-shaped arms 114*a* and 114*b* pivotally mounted to the support frame 80 via a pivot pin 116. A handle member 118 rigidly connects together the first and second L-shaped arms 114*a* and 114*b* at their first ends 120*a* and 120*b*. Second ends 122*a* and 122*b* of the first and second L-shaped arms 114*a* and 114*b* include latching notches 124*a* and 124*b*. The latching notches 124*a* and 124*b* are adapted to releasably receive (i.e., engage) the latch lugs 43A on the handle 38A of the lid member 20A for the original container 16A to secure the latch lugs 43A in the latch slots 115*a* and 115*b* of the plates 111*a,* 111*b*. The L-shaped arms 114*a* and 114*b* of the second engaging mechanism 102 are pivotally movable as a unit, as represented by double headed arrow 125, between an unlatched state, wherein the original container 16A of the liquid paint component 14 can be engaged with and disengaged from the first and second engaging mechanisms 100 and 102 (shown in FIG. 6); and a latched state, wherein the original container 16A is securely held between the first and second engaging mechanisms 100 and 102 (shown in FIG. 7). As such the L-shaped arms 114*a* and 114*b* (i.e., the second engaging mechanism 102) exhibits only a single-degree-of-freedom of movement (i.e., pivotal movement only) relative to the support frame 80 and the first engaging mechanism 100 (i.e., the first and second spaced arms 104*a* and 104*b*). A tension spring element 126 is coupled between a mounting peg 128 of the support frame 80 and a mounting peg 129 of an extension arm 130 on the L-shaped arm 114*a*. The tension spring element 126 biases the L-shaped arms 114*a* and 114*b* defining a portion of the second engaging mechanism 102 to the latched state against the stop 133. A handle/stop member 134 limits movement of the L-shaped arms 114*a* and 114*b* in a clockwise direction as viewed in FIG. 6.

Figure 9A:
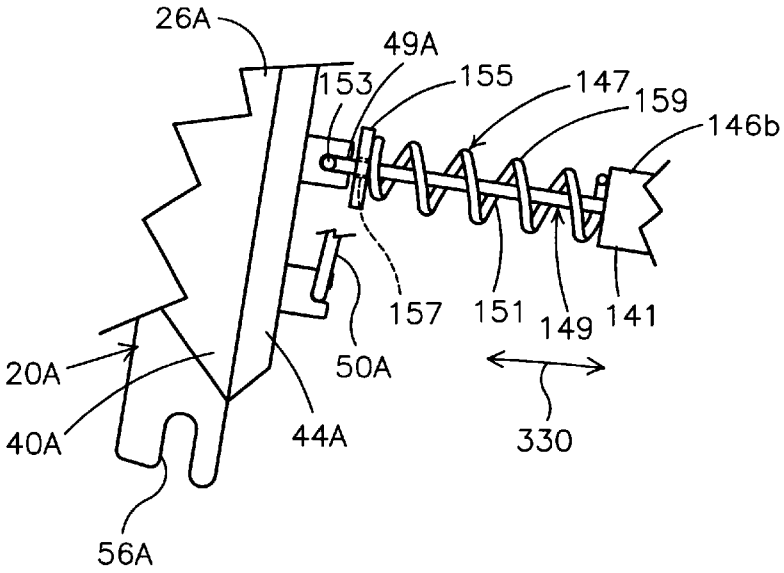
FIG. 9A is an enlarged, partial side elevational view of a force applying mechanism for a cover element of the lid member with the cover element shown in a closed position corresponding to FIG. 7.
Figure 9B:
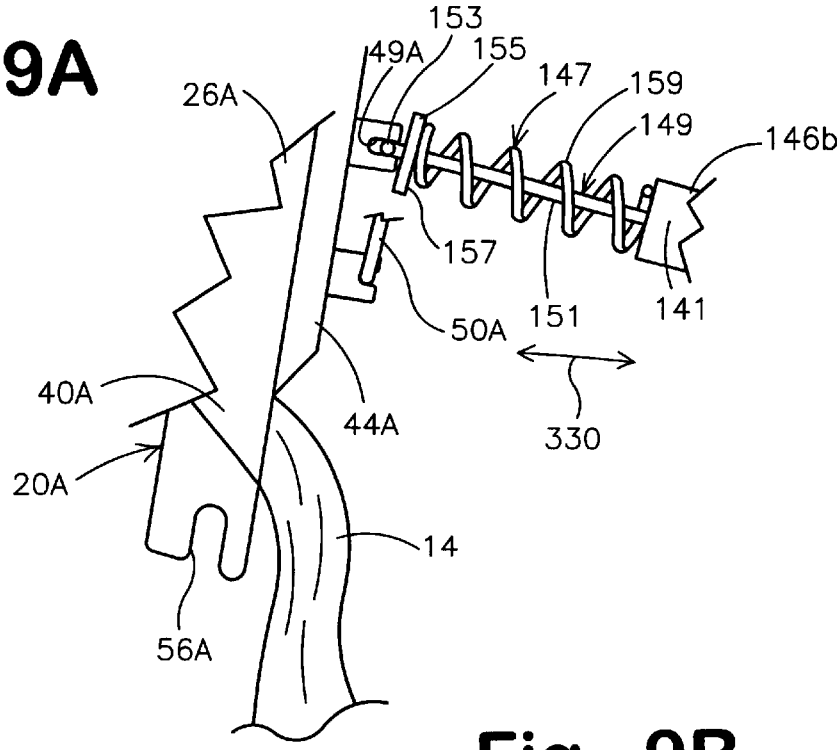
FIG. 9B is an enlarged, partial side elevational view similar to FIG. 9A with the cover element shown in an open position corresponding to FIG. 8.
Figure 10:
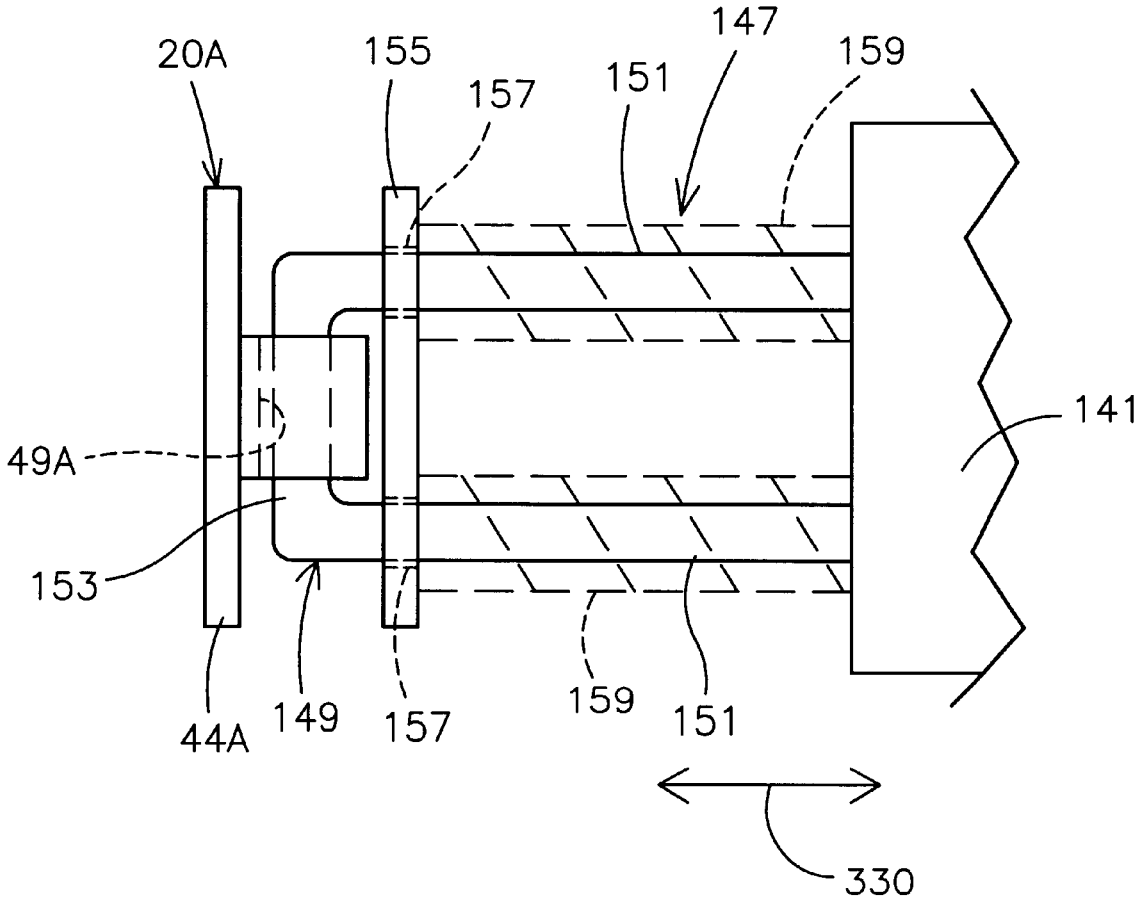
FIG. 10 is an enlarged, partial top elevational view of the force applying mechanism shown in FIG. 9.

As seen best in FIGS. 2 and 6, the dispensing apparatus 12 of the dispensing system 10 further includes dispensing mechanism 140 mounted to the support frame 80 for moving the cover element 44A of the lid member 20A between its closed and open states. The dispensing mechanism 140 includes outwardly extending, first and second arms 142*a* and 142*b* that define an operating device 141 pivotally movable, as a unit, as represented by double headed directional arrow 143 (FIG. 8), relative to the support frame 80 about an axle 145. The free ends 146*a* and 146*b,* of the first and second arms 142*a* and 142*b,* include a force applying mechanism 147 (seen best in FIGS. 9–10) adapted to releasably engage the slot 49A in the cover element 44A on the lid member 20A (see FIGS. 6–10). The force applying mechanism 147 includes U-shaped wire member 149 having legs 151 and a connecting portion 153. The legs 151 are rigidly mounted to the operating device 141. As seen best in FIGS. 9 and 10, the connecting portion 153 is releasably received within the slot 49A of the cover element 44A. The force applying mechanism 147 further includes a force applying plate member 155 that is linearly movable relative to the U-shaped wire member 149 as represented by double headed arrow 330. The force applying plate member 155 includes apertures 157 that freely receive the legs 151 of the U-shaped wire member 149 to permit movement of the plate member 155 along the legs 151. A compression spring 159 surrounds each of the legs 151 and acts between the operating device 141 and the plate member 155 to provide a biasing force urges the plate member 155 against the cover element 44A to prevent inadvertent leakage of the liquid paint component 14 from the pour spout 40A of the lid member 20 atop the original container 16A when the original container 16A is mounted in the dispensing system 10 (see FIG. 7) and the cover element 44A is in a closed position.

Figure 8:
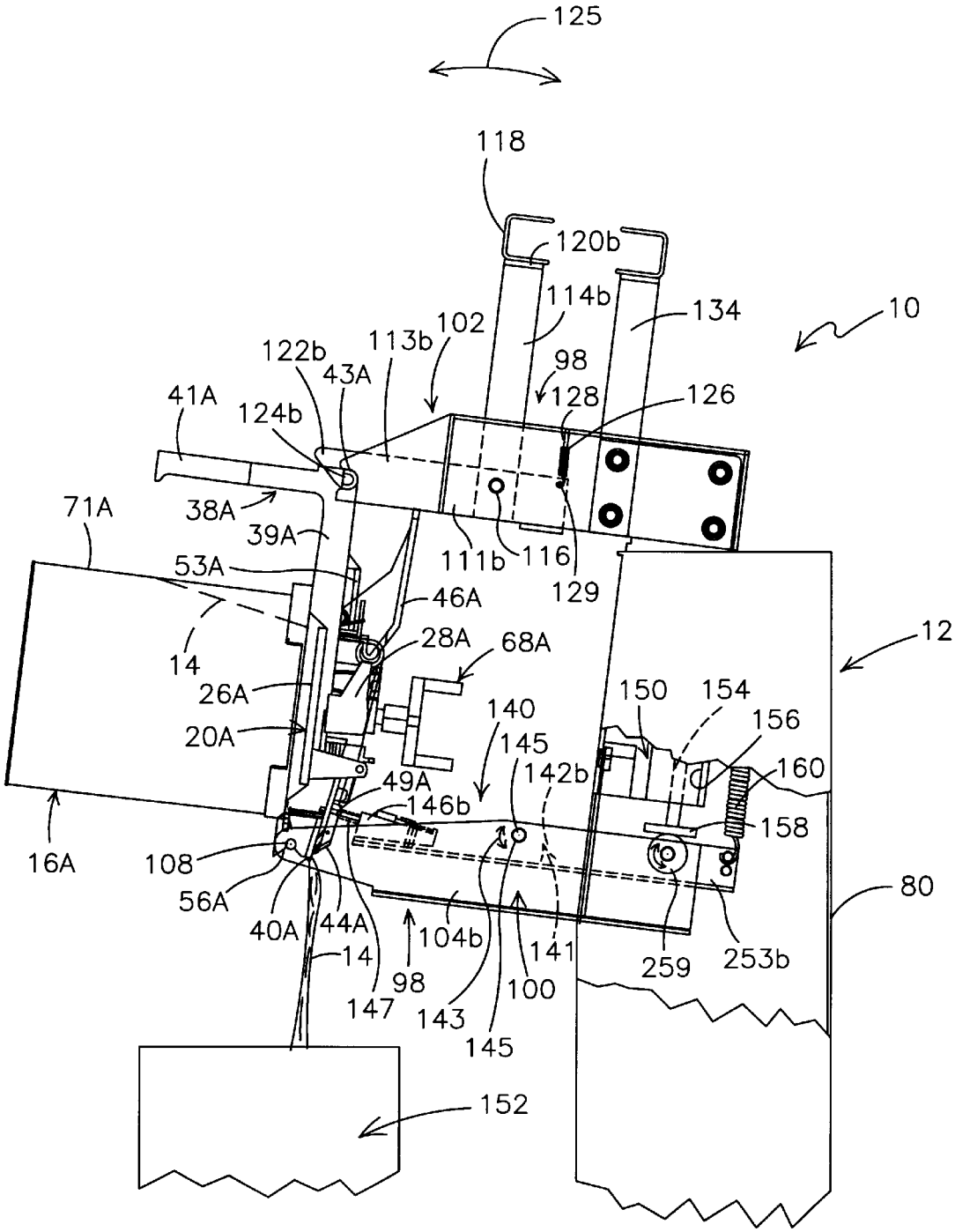
FIG. 8 is a partial side elevational view with some parts omitted for clarity similar to FIG. 7, illustrating the liquid paint component being dispensed from its quart size original container.

As seen in FIG. 8, with the connecting portion 153 of the force applying mechanism 147 of the operating device 141 engaged with the slot 49A of the cover element 44A, a transit mechanism 150 of the dispensing mechanism 140 can pivotally move the operating device 141 between a first position and a second position. In the first position of the operating device 141 (FIG. 7), the cover element 44A of the lid member 20A is in its closed state which prevents the liquid paint component 14 from being dispensed from the original container 16A with the help of the force applying mechanism 147. In the second position of the operating device 141 (FIG. 8), the cover element 44A is in its opened state which allows the liquid paint component 14 to be dispensed (i.e., poured) from the original container 16A into a paint receptacle 152 (FIG. 1).

As set forth previously, the handles 38A and 38B of each of the lid members 20A and 20B include the latch lugs 43A, 43B. The difference in positioning of these latch lugs 43A and 43B between the quart size lid member 20A and the gallon size lid member 20B results in the latch lugs 43A, 43B being the same position relative to the alignment slot 56A, 56B. This allows the receiving mechanism 98 (defined by the first and second engaging mechanisms 100 and 102) and the dispensing mechanism 140 to accommodate quart size original containers 16A (FIGS. 6–8) and gallon size original containers 16B (FIG. 11).

As seen best in FIG. 6, the transit mechanism 150 of the dispensing mechanism 140 includes a piston member 154 linearly movable, along directional arrow 143 (FIG. 6), relative to a cylinder member 156. Opposite ends 253*a* and 253*b* of the first and second arms 142*a* and 142*b* (defining the operating device 141) are coupled to the piston member 154. A pad member 158 of the piston member rides on a roller member 259 rotatably mounted to the arms 142*a,* 142*b*. Therefore movement of the piston member 154 within the cylinder member 156 causes the operating device 141 to move between its first and second positions. Tension spring elements 160 are coupled between the opposite ends 253*a,* 253*b* of the arms 142*a,* 142*b* and a mounting member 162 on the support frame 80. The tension springs 160 bias the operating device 141 to its first position (also known as the primary position of the piston member 154).

As seen in FIG. 1, a drive mechanism 170 of the transit mechanism 150 moves the piston member 154 relative to the cylinder member 156. The drive mechanism 170 includes a piston member 172 linearly movable, along double headed directional arrow 173, relative to a cylinder member 174 mounted to a frame 176 via bracket structure 177. A drive motor, such as a stepper motor 178, is also mounted to the frame 176. The drive motor 178 includes a drive screw 179 that is telescopically received within a drive tube 180 that is secured at one end to the piston member 172. The drive tube 180 is slidably received within a bearing 181 of the frame 176 to allow movement of the drive tube 180, and the piston member 172 therewith, relative to the frame 176, drive motor 178 and cylinder member 174. An opposite end of the drive tube 180 includes a drive nut 183 that threadably receives the drive screw 179 of the stepper motor 178. Operation of the stepper motor 178 turns the drive screw 179 within the drive nut 183. This in turn moves the drive tube 180 and therewith the piston member 172 within the cylinder member 174 along directional arrow 173. A fluid reservoir 182 containing a hydraulic fluid 184 is in fluid communication with the cylinder member 174. A fluid line 188 couples the fluid reservoir 182 to the cylinder member 156. In operation, movement of the piston member 172, via the stepper motor 178, forces hydraulic fluid 184 to move to and from the cylinder member 174 and the fluid reservoir 182 through the line 188 then into and out of the cylinder member 156 to move the piston member 154. Movement of the piston member 154, via the above described hydraulic fluid pressure, in turn moves the operating device 141 which in turn moves the cover element 44A of the lid member 20A between its opened and closed states.

Figure 12:
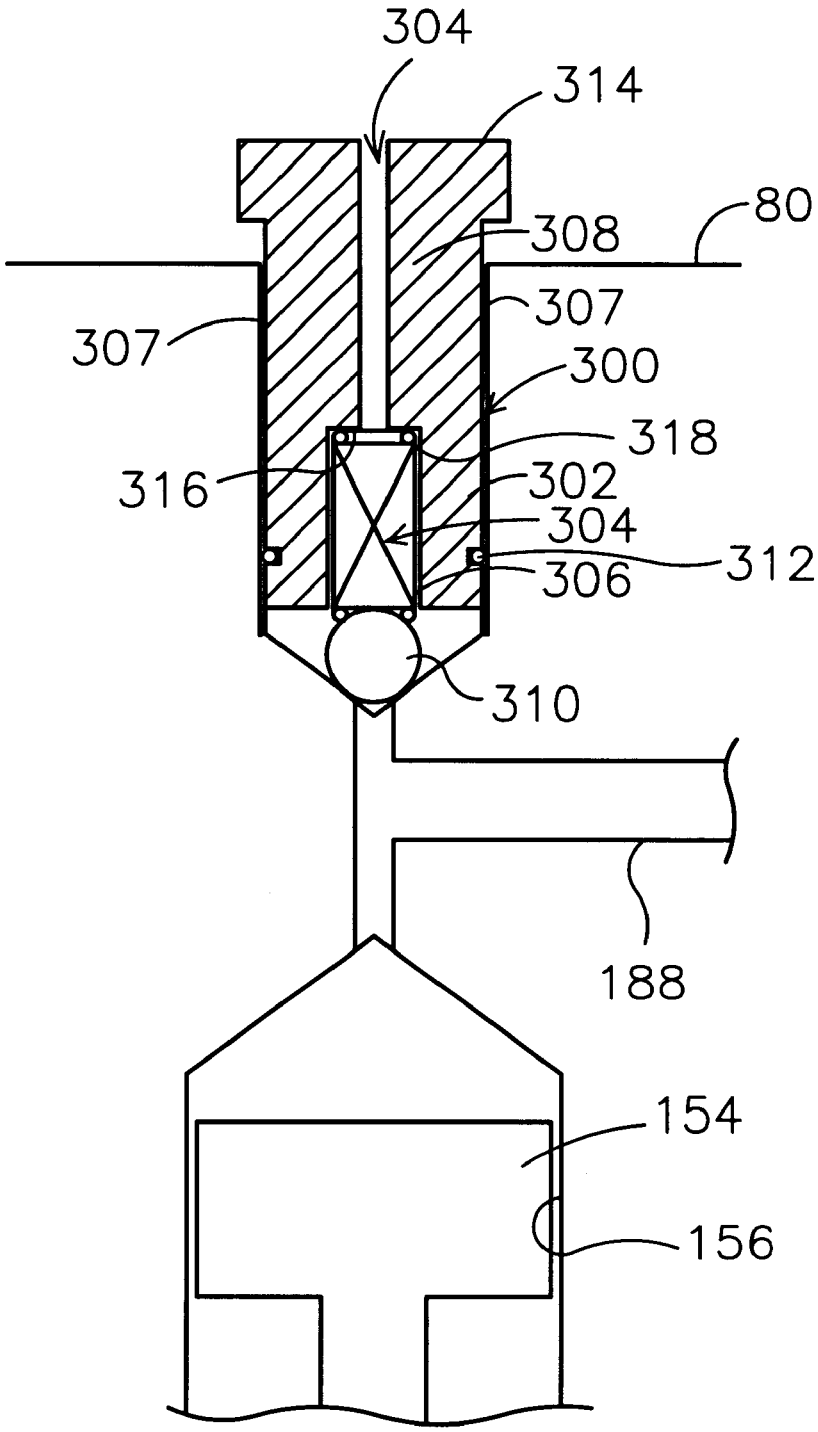
FIG. 12 is a partial side elevational view of an automatic bleeder valve of the semi-automated dispensing system of the present invention with the valve shown in a closed position.
Figure 13:
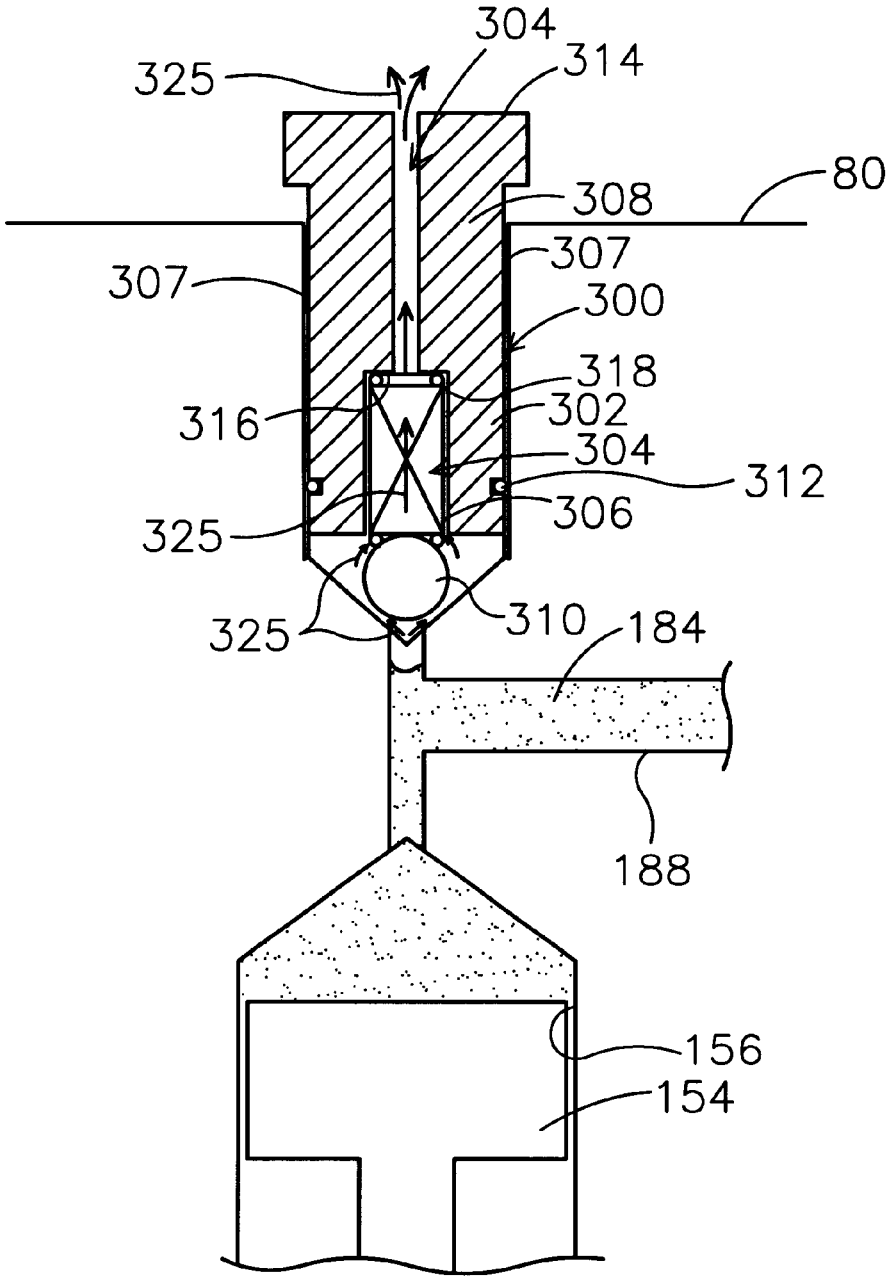
FIG. 13 is a partial side elevational view similar to FIG. 12 illustrating the automatic bleeder valve in an opened position.

As seen in FIGS. 12 and 13, the dispensing system 10 includes an automatic bleeder valve 300 to aid in initially filling the dispensing system 10 with hydraulic fluid 184. The hydraulic bleeder valve 300 includes a body member 302 defining an orifice 304 that extends through the body member 302 from a first end 306 to a second end 308. The orifice 304 is in fluid communication with the fluid line 188 and the cylinder member 156. A linearly movable ball valve 310 is positioned at the first end 306 of the body member 302. The ball valve 310 is movable between a first position, wherein the ball valve 310 forms a fluid seal and air/hydraulic fluid 184 is prevented from passing into the orifice 304 (see FIG. 12), and a second position wherein the ball valve 310 acts as a check valve and air and/or hydraulic fluid 184 may pass through the orifice 304 from the first end 306 to the second end 308 (see FIG. 13). The body member 302 threadably engages the support frame 80 via threads 307 so as to be movable linearly relative thereto. The body member 302 includes a nut 314 at the second end 308 used to twist the body member 302 to move the body member 302 relative to the support frame 80. Near the first end 306, the body member 302 includes an O-ring seal member 312 to prevent air/hydraulic fluid 184 from flowing past the body member 302 through the threads 307. An inner end 316 of the body member 302 bears against a compression spring 318 that in turn bears against the ball valve 310.

In operation, to fill the cylinder member 156 with hydraulic fluid 184, the body member 302 is loosened using the nut 314 which decompresses the spring 318 and allows the ball valve 310 to move to the position shown in FIG. 13. Hydraulic fluid 184 is then pumped through the fluid line 188 from the reservoir 182 via the piston member 172 of the drive mechanism 170. The hydraulic fluid 184 passes from the fluid line 188 into the cylinder member 156 primarily due to gravity and because this is the fluid path of least resistance. Air within the fluid line 188 and the cylinder member 156 is automatically bled out (by the introduction of the hydraulic fluid 184) through the automatic bleeder valve 300. The air passes around the ball valve 310, through the spring 318 and through the orifice 304 as represented by the arrows 325 in FIG. 13. The fluid line 188 and cylinder member 156 are full of hydraulic fluid 184 when the hydraulic fluid 184 passes out of the orifice 304. The body member 302 is then tightened using the nut 314 which causes the inner end 316 of the body member 302 to bear against the spring 318 which compresses the spring against the ball valve 310 sealing off the orifice 304 of the bleeder valve 300, thereby completing the filling process (see FIG. 12).

As seen in FIG. 1, the control apparatus 18 of the dispensing system 10 includes a weigh cell 190 for supporting the paint receptacle 152 and a control module 192. The weigh cell 190 determines the weight of the liquid paint component dispensed (i.e., poured) from the original container 16A into the paint receptacle 152. The control module 192 includes a display monitor device 194 having a display 195, a microprocessor device 196, a data storage device 198 and a user interface device, such as a keyboard 200. The keyboard 200 is coupled to the microprocessor device 196 via a communication line 202. The microprocessor device 196 and the data storage device 198 are linked through a communication line 204. The microprocessor device 196 is linked to the stepper motor 178 and to a sensor 205 for monitoring the position of the drive screw 179 through the communication line 206. The microprocessor device 196 is linked to the display monitor device 194 through communication line 208 and is further linked to the weigh cell 190 via communication line 210. Since the control module 192 (i.e., microprocessor device 196) is linked to the stepper motor 178 and the sensor 205, the control module 192 can control operation of the stepper motor 178, and thereby movement of the piston members 172 and 154, and hence movement of the cover element 44A to dispense the liquid paint component 14 from the original container 16A. In addition, since the control module 192 is further linked to the weigh cell 190, the control module 192 can control the amount (i.e., the weight) of the liquid paint component 14 dispensed from its original container 16A to the paint receptacle 152 (atop the weigh cell 190) based upon data (i.e., information) obtained from the weigh cell 190. Moreover, since the control module 192 (i.e., the data storage device 198) stores the paint formulas, the control module 192 can determine which liquid paint components 14 and the weights of these components needed to duplicate a particular paint formula and can control the dispensing mechanism 140 in accordance therewith.

As seen in FIG. 1, the control module 192 and the drive mechanism 170 are positioned in another room such that the communication line 210 and the fluid line 188 pass through a wall 212 so as to provide explosion protection for the dispensing system 10. Alternatively, one or more of the display monitor device 194, the microprocessor device 196, and the keyboard 200 could be located next to the dispensing system 10 provided that these components are explosion protected.

In operation, to mix a particular paint formula, the operator of the semi-automated dispensing system 10 first accesses the control module 192 through the keyboard 200 to call up the desired paint formula using the microprocessor device 196 the data storage device 198. The paint formula (i.e., the liquid paint components 14) is then displayed on the display 195 of the display monitor device 194. The operator then loads the first container 16A, 16B of the needed liquid paint components into the dispensing apparatus 12.

As seen in FIG. 6, to mount (i.e., load) an original container 16A of a liquid paint component 14 to the receiving mechanism 98 of the dispensing apparatus 12, the operator of the dispensing system 10 first needs to pivot the second engaging mechanism 102 (defined by the L-shaped arms 114*a*, 114*b*) clockwise (as viewed in FIG. 6) from its normal latched state to its unlatched state, against the handle/stop member 134 mounted to the support frame 80. The operator, while gripping both the handle member 118 and the handle/stop member 134 to hold the second engaging mechanism 102 in its unlatched state (against the bias of the spring element 126), then engages the alignment slot 56A of the lid member 20A with the registration rod 108 of the first engaging mechanism 100 (FIG. 6). Next, while still holding the second engaging mechanism 102 in its unlatched state, the operator pivots the container 16A and lid member 20A combination clockwise (as viewed in FIG. 6) until the connecting portion 153 of the force applying mechanism 147 of the operating device 141 is fully seated in the slot 49A of the cover element 44A, and the latch lugs 43A are fully seated in the latch slots 115*a,* 115*b* of the plates 111*a,* 111*b.* With the alignment slot 56 now fully seated on the registration rod 108, the connecting portion 153 of the operating device 141 fully seated in the slot 49A of the cover element, and the latch lugs 43A fully seated in the latch slots 15*a,* 115*b,* the operator pivots the second engaging mechanism 102 counter-clockwise to its latched state, so that the latching notches 124*a* and 124*b* engage the latch lugs 43A of the lid member 20A securing the original container 16A lid member 20A combination to the receiving mechanism 98 the dispensing apparatus 12. To remove the container 16A for the dispensing apparatus 12, this above described process is simply reversed.

The operator then starts the dispensing process using the keyboard 200 of the control module 192. Since the control module 192 (i.e., microprocessor device 196) is linked to the stepper motor 178 and the sensor 205, the control module 192 controls operation of the stepper motor 178, and thereby movement of the piston members 154 and 172, and hence movement of the cover element 44A to dispense (i.e., pour) the liquid paint component 14 from the original container 16A into the paint receptacle 152. The arrangement of the second engaging mechanism 102 and the latch lugs 43A prevents movement of the cover element 44A from inadvertently disengaging the alignment slot 56A from the first registration rod 108. The weight of the liquid paint component 14 dispensed into the paint receptacle 152 is monitored by the control module 192 through the weigh cell 190, thereby ensuring an accurate liquid paint component pour. Once the first liquid paint component 14 is poured, its container 16A, 16B is removed and is replaced with the next paint component container 16A, 16B and so on, until all paint components 14 of the paint formula have been added to the paint receptacle 152, thereby completing the paint formula mixing process.

This lid member 20A, 20B can be used with the original container 16A, 16B of a liquid paint component 14 and the resilient seal mechanism 354 prevents contaminants from entering the original paint component container 16A, 16B through the pour spout/cover element interface 356. In addition, the resilient seal mechanism 354 of the lid member 20A, 20B prevents undesired leakage of the paint component 14 out of the pour spout 40A and past the cover element 44A in the closed state of the cover element 44A. Unwanted leakage of just four drops of the liquid paint component 14 from pour spout 40A, when the container 16A, 16B is mounted the dispensing system 10, can result in the addition of 0.1 grams of unwanted paint component 14 to the paint receptacle 152 which could require the operator of the dispensing system 10 to re-pour other paint components to compensate for this error. In addition, this lid member 20A, 20B is compatible with the semi-automated dispensing system 10, for dispensing liquid paint components 14 from their original containers 16A, 16B that virtually eliminates system operator errors, in particular over pouring errors, that can be costly to a body shop or jobber. The lid member 20A, 20B together with the semi-automated dispensing system 10 is easy to use, and does not require a highly skilled operator, since operator interface with the lid members 20A, 20B and the dispensing system 10 is substantially limited to identifying the desired paint formula, and loading and unloading the proper containers 16A, 16B of the liquid paint components 14 to and from the dispensing apparatus 12. The operator need no longer manually pour the paint components 14 from their containers 16A, 16B. The lid member/dispensing system interface automatically dispenses (i.e., pours) the liquid paint components 14 from their containers 16A, 16B, thereby ensuring a highly accurate, precision liquid paint component pour. Moreover, the vent passage 55A, 55B arrangement prevents liquid paint component from flowing out of the second open end 59A, 59B of the vent passage during dispensing of the paint component from the container 16A, 16B. In addition, the lid members 20A, 20B, of the present invention, together with the paint dispensing system 10, makes efficient use of the operator's time, since the operator is free to perform other duties instead of holding the containers 16A, 16B and performing the task of manually pouring the proper amounts of the liquid paint components 14. This efficiency gain allows the operator to mix a greater number of paint formulas during a work day. Lastly, the paint component lid members 20A, 20B, of the present invention, and the semi-automated dispensing system 10 comply with all regulations and laws, such as being explosion protected, governing the handling and mixing of liquid paint components 14 for the duplication of automotive paint formulas.

Although the present invention has been described with reference to preferred embodiments, workers skilled in the art will recognize that changes may be made in form and detail without departing from the spirit and scope of the invention. For example, although the lid members 20A and 20B and the semi-automated dispensing system 10 have s been described as useable to dispense liquid automotive paint components 14 from their original containers 16A and 16B, lid members and the dispensing system can be used to dispense other pourable components, such as primers, thinners and liquid or powdered chemicals. In particular the lid members 20A and 20B and the dispensing system 10 could be used in laboratory or pharmaceutical organizations to accurately dispense liquid and powdered chemicals according to a desired formula.

What is claimed is:

1. A lid member for an original container of a pourable component, the lid member being usable with a system for dispensing the pourable component from its original container into a receptacle according to a formula to form a mixture of pourable components, the lid member comprising:

a base portion adapted to releasably engage an open top of a side wall of the original container of the pourable component;

a pour spout on the base portion through which the pourable component can be dispensed from its original container, the pour spout having a circumferential, planar edge surface;

a cover element for the pour spout, the cover element having a planar lower surface and being movably mounted to the base portion such that the cover element is movable between a closed state, wherein the cover element covers the pour spout, and an opened state, wherein the pour spout is uncovered and the pourable component can be dispensed from its original container through the pour spout into the receptacle upon tilting of the original container; and resilient seal means mounted to the circumferential, planar edge surface of the pour spout at an engagement interface between the circumferential, planar edge surface of the pour spout and the planar lower surface of the movable cover element, the resilient seal means preventing leakage of the pourable component, upon tilting of the original container, out of the pour spout past the cover element in the closed state of the cover element.

2. The lid member of claim 1 wherein the circumferential, planar edge surface of the pour spout includes a circumferentially extending channel, and wherein the resilient seal means is mounted in the channel.

3. The lid member of claim 2 wherein the resilient seal means is an O-ring.

4. The lid member of claim 3 wherein the O-ring is made of rubber.

5. The lid member of claim 1 wherein the resilient seal means is a U-shaped resilient seal member having an engagement channel for receiving the circumferential, planar edge surface of the pour spout for mounting the resilient seal member to the pour spout.

6. The lid member of claim 5 wherein a sealing surface of the resilient seal member includes a circumferential ridge that engages and conforms to the shape of the planar lower surface of the cover element.

7. The lid member of claim 5 wherein the resilient seal member includes a circumferential extension that engages and conforms to the shape of the planar lower surface of the cover element.

8. The lid member of claim 7 wherein the circumferential extension is directed exterior to the pour spout.

9. The lid member of claim 5 wherein the resilient seal member is made of rubber.

10. The lid member of claim 1 wherein the pourable component is a liquid paint component, the receptacle is a paint receptacle, the formula is a paint formula, and the mixture of pourable components is a liquid paint mixture.

11. A lid member for an original container of a pourable component, the lid member being usable with a system for dispensing the pourable component from its original container into a receptacle according to a formula to form a mixture of pourable components, the lid member comprising:

a base portion adapted to releasably engage an open top of a side wall of the original container of the pourable component;

a pour spout on the base portion through which the pourable component can be dispensed from its original container, the pour spout having a circumferential, planar edge surface;

a cover element for the pour spout, the cover element having a planar lower surface and being movably mounted to the base portion such that the cover element is movable between a closed state, wherein the cover element covers the pour spout, and an opened state, wherein the pour spout is uncovered and the pourable component can be dispensed from its original container through the pour spout into the receptacle upon tilting of the original container; and resilient seal means mounted to the cover element so as to cover the planar lower surface of the cover element at an engagement interface between the circumferential, planar edge surface of the pour spout and the planar lower surface of the cover element so that the resilient seal means engages and conforms to a shape of the entire circumferential, planar edge surface of the pour spout, the resilient seal means preventing leakage of the pourable component, upon tilting of the original container, out of the pour spout past the cover element in the closed state of the cover element, the resilient seal means including: a first substrate of a resilient foam that engages the planar lower surface of the cover element; and a second substrate of a smooth polyethylene that engages the circumferential, planar edge surface of the pour spout to allow the cover element to readily move between the closed and open states.

12. The lid member of claim 11 wherein the resilient seal means covers the entire planar lower surface of the cover element.

13. The lid member of claim 11 wherein the pourable component is a liquid paint component, the receptacle is a paint receptacle, the formula is a paint formula, and the mixture of pourable components is a liquid paint mixture.

* * * * *